United States Patent [19]

Buckingham et al.

[11] 4,237,676

[45] Dec. 9, 1980

[54] METHOD AND APPARATUS FOR PACKAGING CONTAINERS

[75] Inventors: James W. Buckingham, Pemberville; Stephen W. Amberg, Toledo, both of Ohio

[73] Assignee: Owens-Illinois, Inc., Toledo, Ohio

[21] Appl. No.: 18,962

[22] Filed: Mar. 9, 1979

[51] Int. Cl.[3] ..... B65B 21/24; B65B 53/06

[52] U.S. Cl. ..... 53/398; 53/441; 53/442; 53/459; 53/48; 53/557; 53/567

[58] Field of Search ..... 53/398, 459, 469, 441, 53/479, 567, 48, 442, 557

[56] References Cited

U.S. PATENT DOCUMENTS

| | | | |
|---|---|---|---|
| 2,612,738 | 10/1952 | Salfisberg | 53/567 X |
| 3,417,540 | 12/1968 | Copping et al. | 53/557 X |
| 3,594,978 | 7/1971 | Spitznagel | 53/567 |
| 3,662,514 | 5/1972 | Goss | 53/469 |
| 3,664,088 | 5/1972 | Sherman | 53/557 X |
| 3,782,070 | 1/1974 | Erlandson | 53/557 |
| 4,165,595 | 8/1979 | Pilley et al. | 53/567 X |

*Primary Examiner*—Horace M. Culver

*Attorney, Agent, or Firm*—E. J. Holler; M. E. Click; D. H. Wilson

[57] ABSTRACT

Method and apparatus are provided for assemblying bottles or other containers into a package. The bottles for a package are arranged in a group of predetermined number, a telescoping tubular sleeve is placed around the group, and the sleeve is heat-shrunken around the grouped bottles into an integral tightly-bound package.

25 Claims, 26 Drawing Figures

SECTION B-B

SECTION C-C

SECTION D-D

SECTION E-E

SECTION F-F

METHOD AND APPARATUS FOR PACKAGING CONTAINERS

This invention relates to method and apparatus for assemblying containers into a package and more particularly to a method and apparatus for assemblying a preformed, heat-shrinkable, flexible, tubular wrap around a group of bottles to form a convenient and durable package for shipping, handling and carrying.

BACKGROUND OF THE INVENTION

It is common practice to merchandise many items such as containers of soft drinks, beer, and the like, in packages containing a number of similar containers with the package normally including a handle or other means to facilitate carrying of the package. One of the most common packages consists of a relatively-rigid, paperboard blank formed around a group of containers, generally six or eight, with the folded blank usually being interlocked with itself and with the containers in the package. Normally, the package provides partitions between individual containers to cushion the same against damage or breakage during shipment. However, these paperboard blank packages have not been entirely satisfactory in that they are relatively expensive and difficult to form and pack at the high speeds required by modern filling and packaging machines.

To overcome these deficiencies of the folded paperboard blank, metal cans have recently been packaged by assemblying the cans into a group with an apertured carrier formed from a sheet of resilient plastic material, with the beaded end of the cans being inserted through the apertures of the carrier. The periphery of the apertures grasp the sidewalls of the cans and is locked beneath the bead securely enough to permit carrying of the package by a handle attached to a central portion or finger holes in the plastic carrier. Previously, it was not considered practical to package bottles in this manner because the elongated neck or shoulder portion made existing methods and apparatus impractical for packaging bottles. Also, the need for tight retention of the individual bottles, and the need for providing cushioning partitions between the bottles for handling and shipment have made such apertured carriers of limited value for use with bottles per se.

Methods and apparatus for applying a band around a group of bottles and securely applying a resilient, apertured carrier to the banded group to form a package convenient for shipping and carrying have been disclosed in U.S. Pat. Nos. 3,404,505 and 3,509,684, both of which are assigned to the same common assignee as the present application. Other types of stretchable and elastic packaging devices adapted to be stretch-mounted in grouping engagement with the bottles have been disclosed in U.S. Pat. No. 3,837,478.

SUMMARY OF THE INVENTION

It is an object of the present invention to provide a new and improved plastic multi-pack carrier assemblying method and apparatus for application to a plurality of articles such as non-returnable bottles, and the like, both of which function to provide advantages heretofore unobtainable from prior art methods and apparatus.

More specifically, it is an object of the present invention to provide a plastic, tubular, multi-pack carrier for application to articles such as non-returnable bottles, and the like, which utilizes relatively less material and has a lower manufacturing and assemblying cost than composite paperboard counterparts, can be stored and shipped in a convenient and economical manner, is readily adapted to advertising decoration, can provide light-inhibiting characteristics, and protects the bottles within the package against damage.

Another object of the present invention is to provide a method of applying a new and improved overwrap to containers which can be applied to a group of containers for holding same tightly together as in integral package and can be easily removed from the containers when desired.

Another object of the present invention is to provide a simple and effective high-speed assembly technique for assemblying a preformed tubular, plastic wrap which is readily heat-shrinkable in two dimensions to a group of physically-contacting similar articles.

Another object of the present invention is to provide apparatus for assemblying a preformed tubular plastic wrap to a group of bottles, and the like, which serves as an overwrap and which is applied by new and improved techniques.

These and other objects and advantages of the present invention are obtained by the provision of a flexible double-folded tubular plastic sleeve which is adapted to be applied to a plurality of articles, said sleeve in heat-shrunk condition being a full wraparound except for partially open end portions. The plastic sleeve is preferably prefabricated having predetermined diameter and length dimensions with an axial heat-seal, the sleeve being heat-shrinkable both circumferentially and axially into tight conformity with the enclosed articles.

The stated objects are attained in apparatus suitable for preforming the method of this invention and are adapted for use with a high-speed filling and capping machine to receive the filled, capped bottles issuing from such machine and form them into packages such as the conventional six-pack employed to merchandise soft drinks and beer. The bottles to be packaged are fed by a suitable horizontal conveyor mechanism into spaced groups, each normally consisting of two parallel rows of three bottles each in upright side-by-side relation. The groups of bottles are carried in tight arrangement by the conveyor past a wrap or sleeve opening and applying station at prescribed differential speeds.

Above the sleeve opening and applying station, preformed, flexible, tubular sleeves are fed from a magazine in a double-folded flat condition, one at a time onto a positioning conveyor in spaced-apart relation where they are partially opened and inverted. The sleeve is partially opened at one speed and a hollow shoe element is introduced into the sleeve while moving at a greater speed to fully open the sleeve and capture the same in vertical alignment above the bottle conveyor. With the sleeve positively held open by the shoe element, the sleeve is moved into axial alignment with the spaced group of bottles on the conveyor. The grouped bottles are moved at a greater lineal speed than the hollow open sleeve to telescopically penetrate the same to a central position where they are deposited. The shoe element is then withdrawn from the sleeve and grouped bottles as it moves more slowly along the bottle conveyor path.

From the sleeve-applying station, the sleeve containing the aligned bottles internally is taken to another aligned horizontal conveyor which passes through a heating zone. The sleeve is then heat-shrunk around the bottles into tightly conforming relation. The ends of the package remain partially open after shrinkage due to the preferred orientation of the plastic material comprising the sleeve. The material contracts both circumferentially and axially to firmly retain the major exposed surfaces of the grouped bottles. The bottles are tightly held in surface-to-surface tangential arrangement so that they are immovable in a solid integral package. The package can be rapidly and easily opened by piercing the sleeve adjacent its ends or between bottles at any area.

DESCRIPTION OF PREFERRED EMBODIMENT

Figure 1:
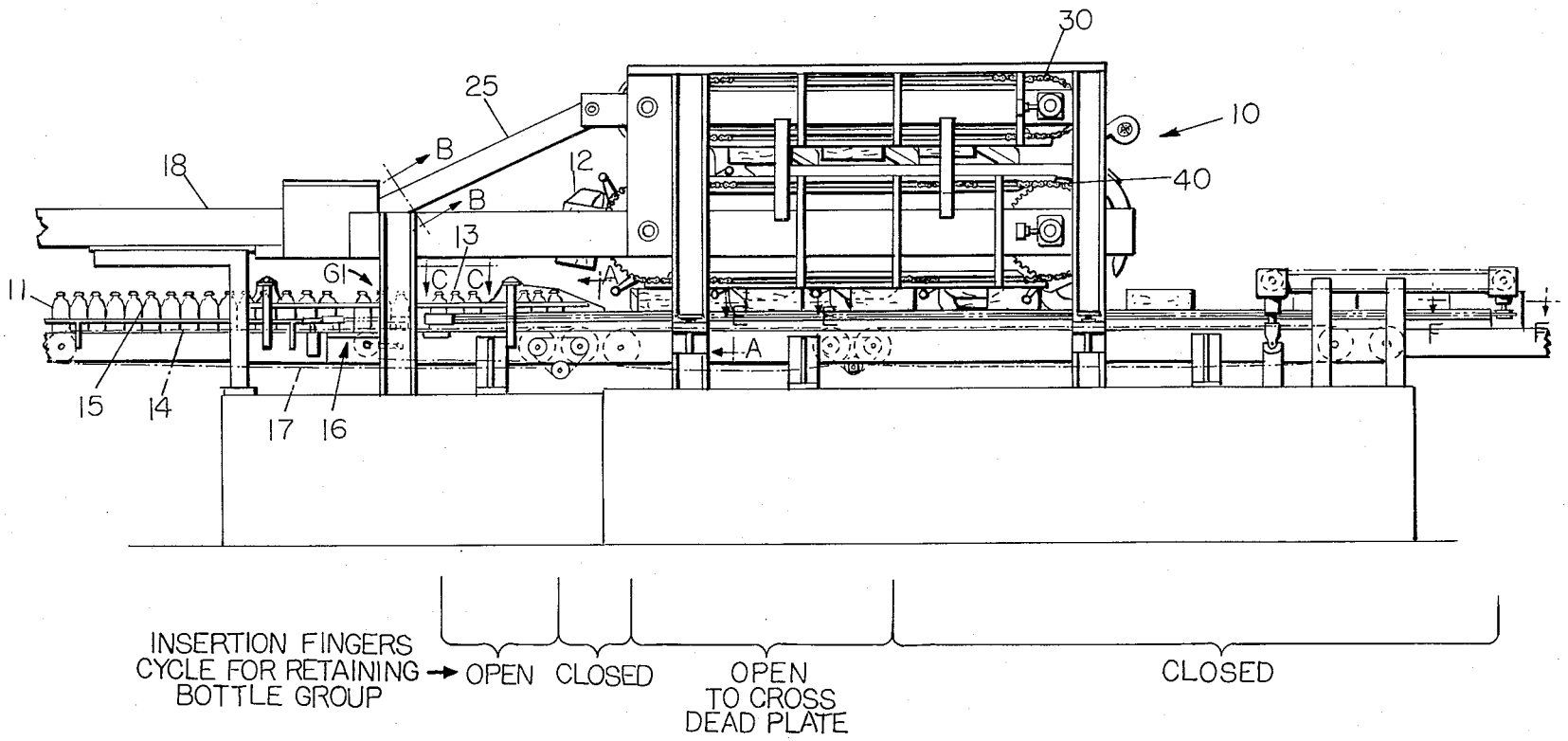
FIG. 1 is a side view of the sleeve-applying machine incorporating the sleeve feeding, opening and applying mechanisms of this invention.

As shown in FIG. 1 of the drawings, the apparatus for packaging containers within tubular plastic sleeves consists of a vertical sleeve-applying machine 10 which is adapted to automatically conveying the containers 11 through the machine and placing a fully-open sleeve 12 around a group 13 of containers. The containers 11 preferably consist of rigid hollow glass bottles which normally are filled and capped ready for packaging and shipment, although the containers may also comprise other types of packages.

The bottles 11 are delivered to the subject vertical sleeve-applying machine 10 on a horizontal linear conveyor 14. Conveyor 14 is of conventional construction adapted to transporting the bottles in upright position between a pair of side rails 15 as shown in FIG. 1. The incoming horizontal linear conveyor 14 is arranged to direct the bottles in two rows in bottle-to-bottle contact until just before horizontal diversion across to the sleeve-applying machine. Just before diversion, a vertically projecting blade (not shown) is stationarily mounted between the two rows to prevent nesting and jamming of the containers as they are swept into an S-curve for introduction onto the infeed conveyor 17 of the horizontally-aligned sleeve application machine 10. The central stationary dividing blade in conjunction with the outer side guide rails 15 effectively separates the containers into two individual aligned rows until just prior to grouped conveyance and introduction of a uniform number of containers into an individual sleeve.

The conveyor 17 is thus arranged to deliver the bottles in two rows in side-by-side tangential arrangement at the incoming end of the vertical sleeve-applying machine 10. The bottles are preferably grouped by suitable grouping mechanism 16 into integral prearranged group 13 so that they are aligned tightly in two uniform rows of three containers each. The grouping mechanism 16 is the subject of another patent application owned by the same common assignee as the present application. The bottles are also able to be grouped into greater or lesser uniform numbers by various other types of grouping mechanisms.

SLEEVE HANDLING

Figure 2:
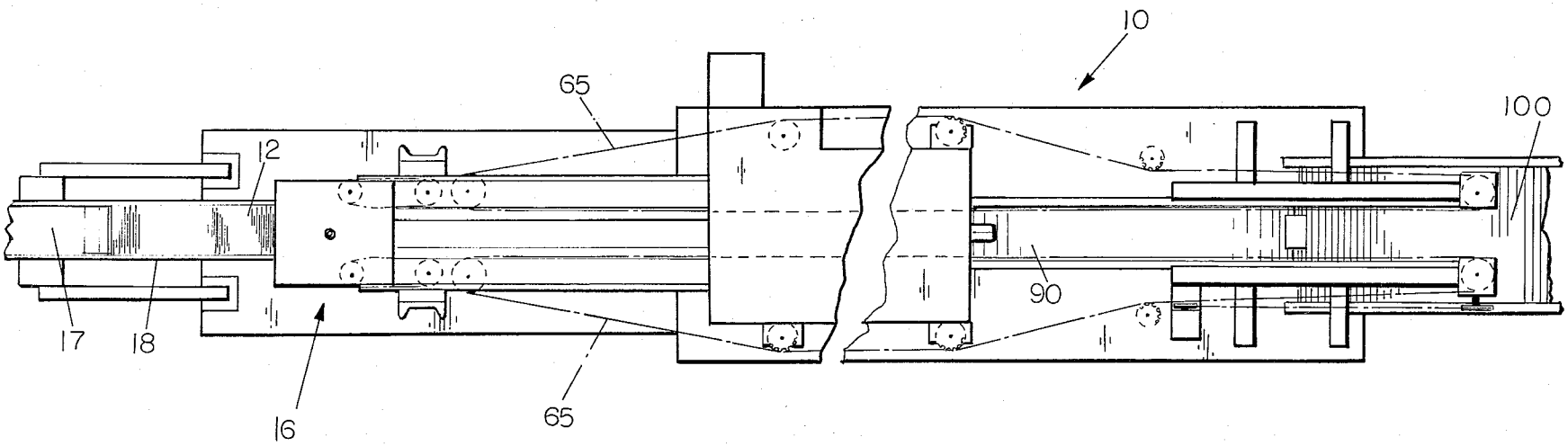
FIG. 2 is a top plan view showing the sleeve-applying machine set forth in FIG. 1.

As shown in FIG. 2, a stack of preformed folded tubular sleeves 12 is held within a suiable magazine-type horizontal holder 18 having internal dimensions closely complemental to the retained nested stack of folded sleeves. The holder 18 is mounted above inlet conveyor 17 and grouping mechanism 16 generally in vertical alignment therewith. The sleeves 12 are doubly folded so that they may be uniformly and tightly aligned vertically in the holder with the open end edges of the folded sleeves uppermost in the stack. The central fold preferably is located at the lowermost position of the stack. The sleeves are preferably fabricated from a roll of preprinted and decorated sheet thermoplastic material, a preferred material being a coextruded laminated sheet of film and foam polyethylene material having a thickness ranging from about 4 to 10 mils. The sleeves have their primary orientation in a circumferential direction and secondary orientation in an axial direction.

The sleeves are prefabricated with a longitudinal fusion-type heat-seal or seam extending throughout their length. The axially-extending heat-seal or seam is normally positioned in a region such as the bottom panel devoid of printing or decorating to avoid matching such patterns and to prevent sealing problems in effecting the fusion seal. The fusion seal being on the bottom is largely out of sight in completing the wrap by heat shrinkage, but a small portion is visible on the package extending upwardly from the bottom to the partial openings at the ends of the package.

Figure 8:
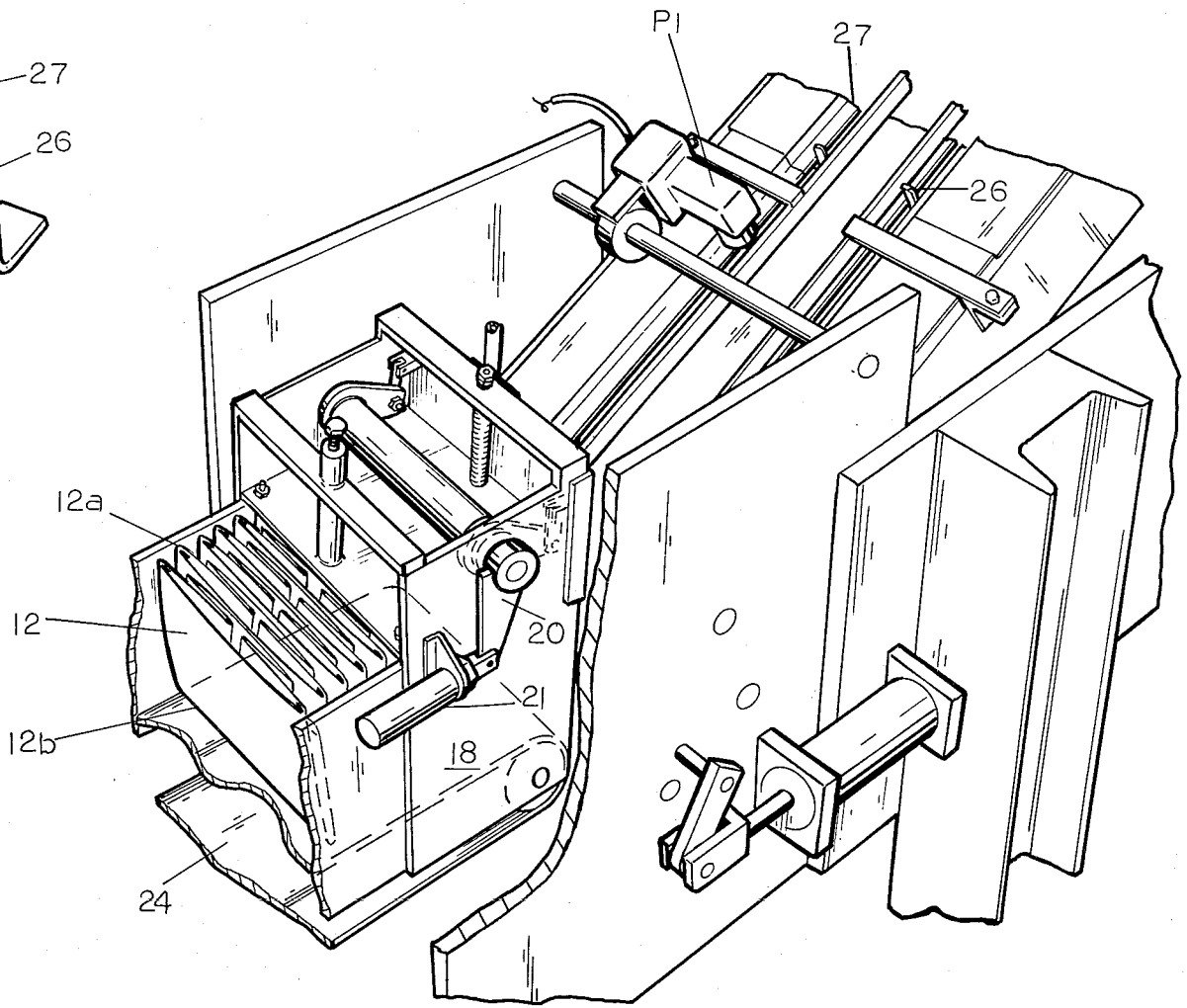
FIG. 8 is an enlarged fragmentary perspective view of the sleeve infeed and spacing mechanism shown on the left-hand side of FIGS. 1 and 2.
Figure 11:
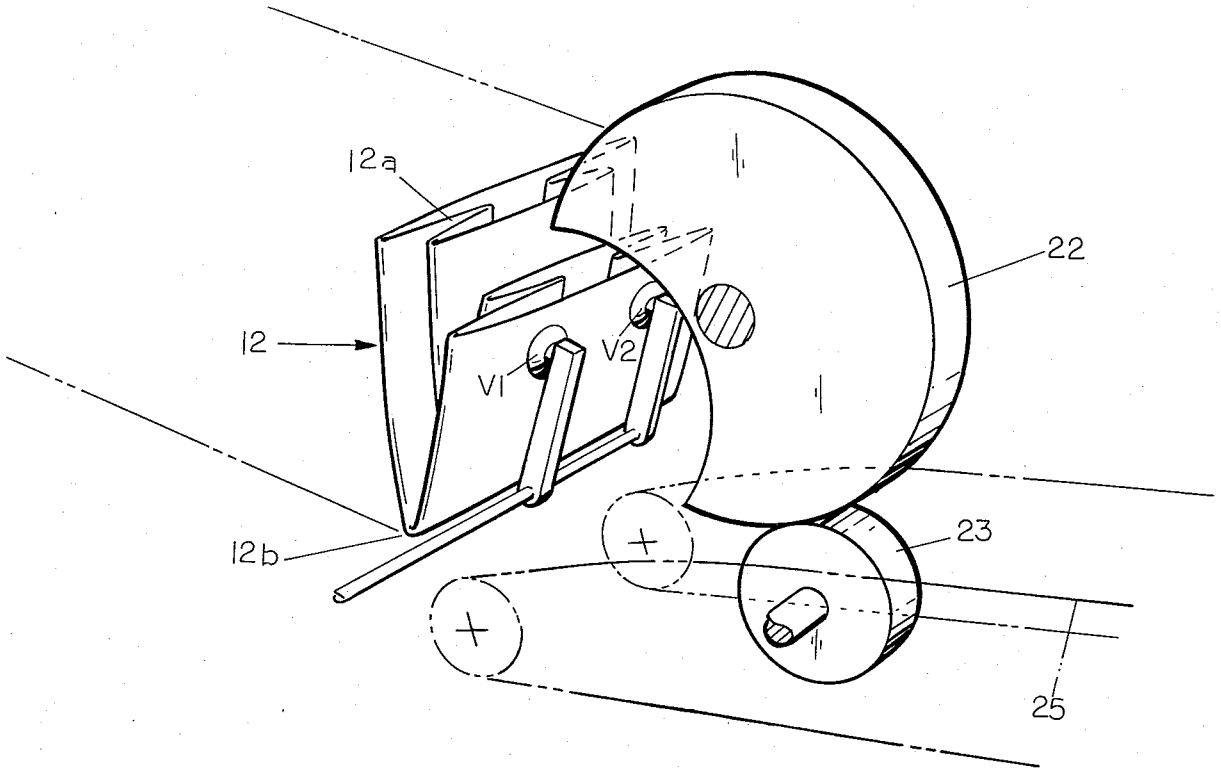
FIG. 11 is a still further enlarged fragmentary perspective view of the vacuum cup and nip roll elements of the sleeve infeed and spacing mechanism shown in FIGS. 8 and 10.
Figure 12:
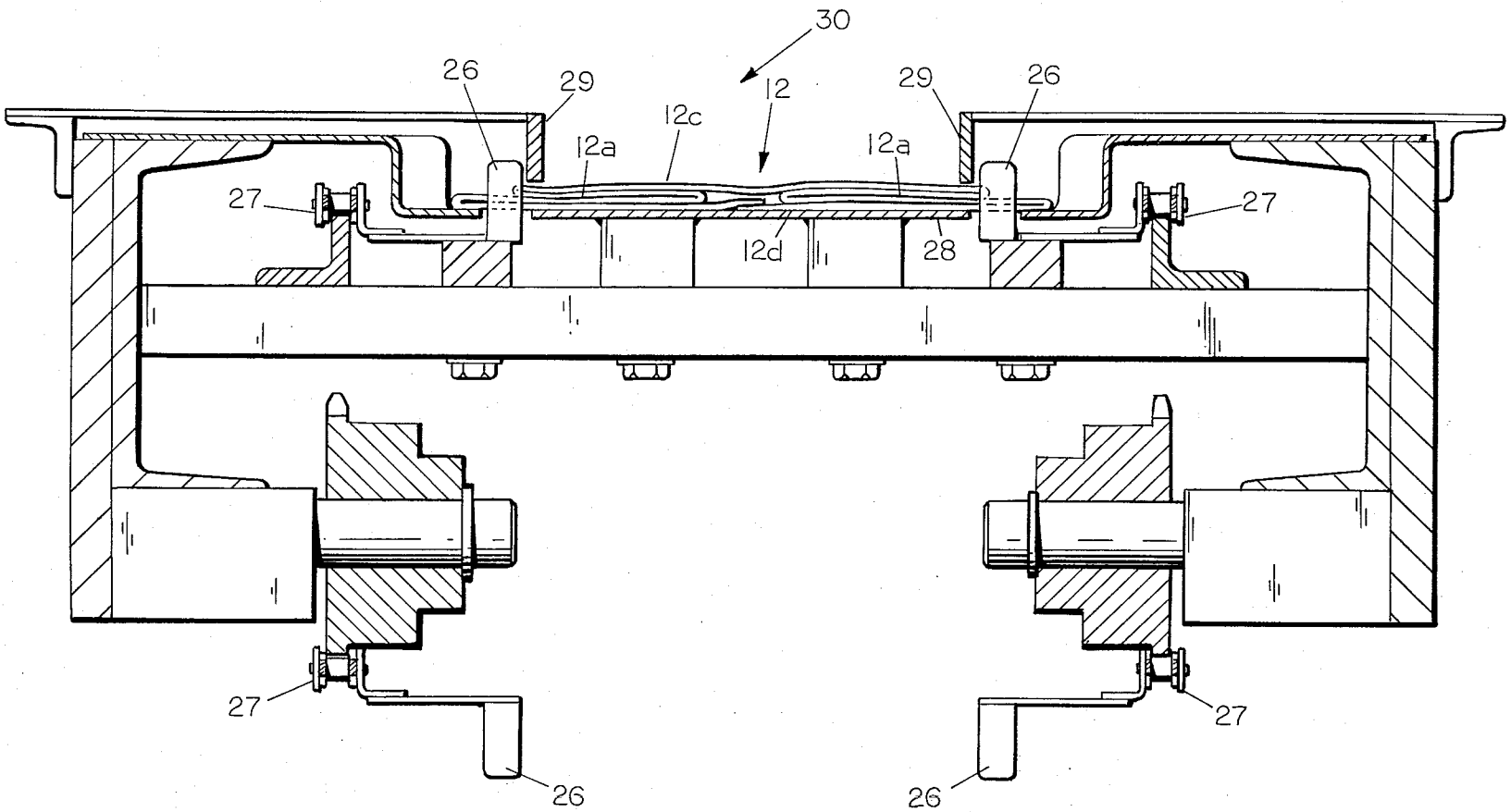
FIG. 12 is a further enlarged transverse vertical sectional view of the sleeve spacing and transporting mechanism substantially as indicated by the line B—B on FIG. 1.

Each preformed tubular sleeve 12 is folded flat having two inwardly and axially extending gusset folds 12*a* along its sides (as shown in FIGS. 8, 11 and 12) which effect folding of the sides on themselves so that the full top panel 12*c* has a narrower width than the bottom panel 12*d*. The top panel 12*c* is then folded on itself in an off-center region 12*b* so that the respective ends of the flattened, tubular sleeves are substantially spaced apart for easy opening. Thus the central transverse fold is unsymmetrical whereby the two halves are of distinctive unequal length. The sleeves are prefabricated having a prescribed length and diameter to loosely surround the transverse circumference of a group 13 of bottles 11 extending substantially beyond their axial dimension at both ends. With the bottom panel 12*d* having a greater width than the top panel 12*c* as folded, the corner regions of the bottom panel 12*d* are fully exposed for firm retention during conveyance upon issuance of an individual sleeve from the holder 18.

Figure 9:
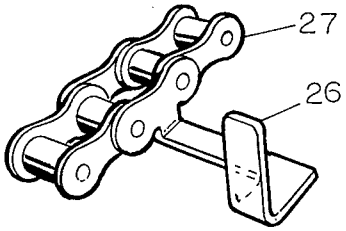
FIG. 9 is a further enlarged fragmentary perspective view of the spacing finger and chain of the sleeve infeed and spacing mechanism shown in FIG. 8.
Figure 10:
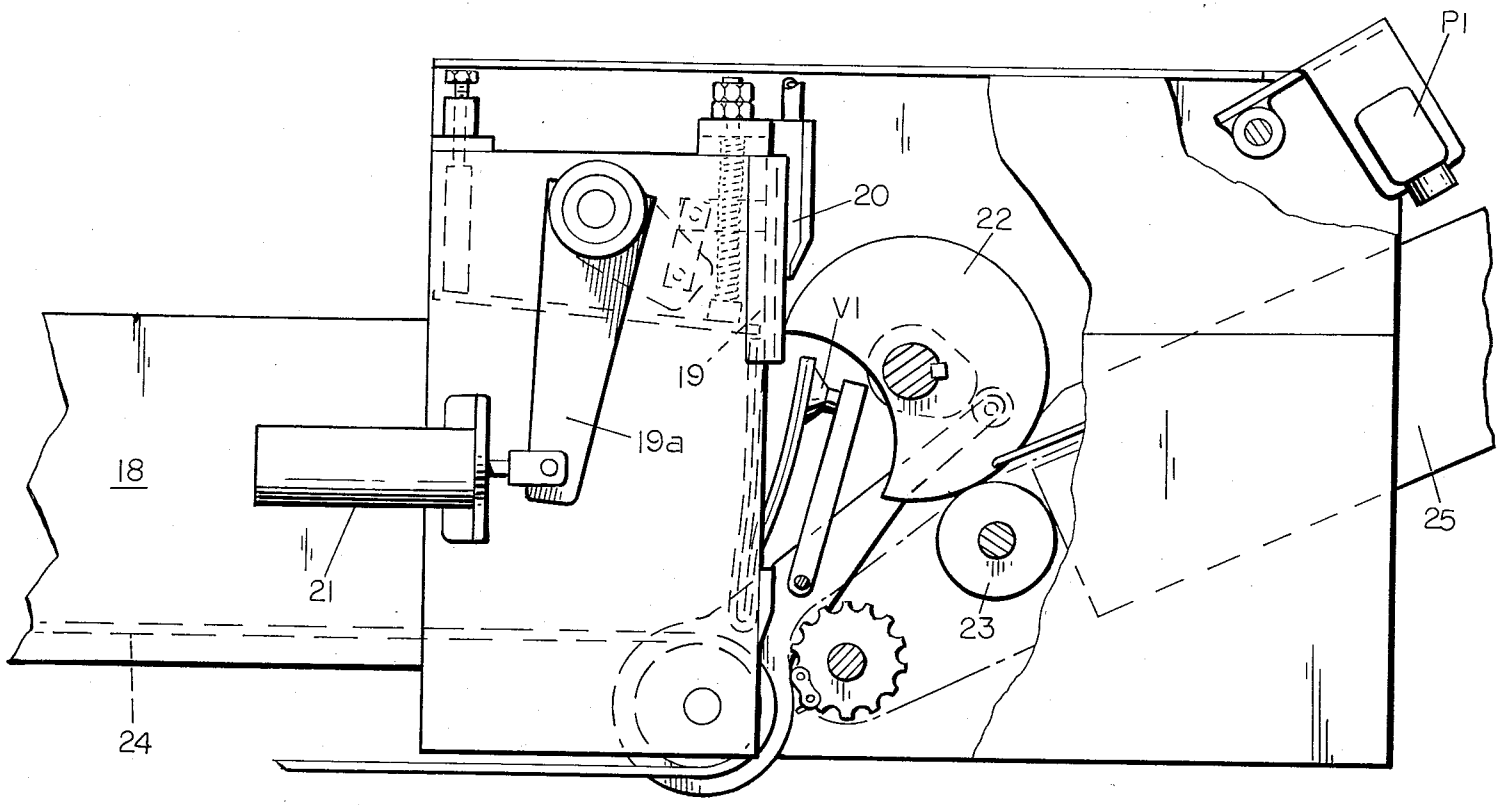
FIG. 10 is a side elevational view partially in broken-away vertical section of the sleeve infeed and spacing mechanism shown in FIGS. 1, 2 and 8.

The sleeve holder 18 is slightly smaller in dimension at the sides of its exit area. A gate 19 is mounted in vertically-reciprocatable arrangement over the exit opening of the horizontal holder as shown in FIGS. 8 and 9 so that delivery of the sleeves can be interrupted as desired when the gate is lowered. The lower extremity of gate 19 normally is positioned to cover the upper extremity of the exposed shorter length portion of the outermost sleeve. The retained sleeves are mounted within holder 18 resting on a slowly-advancing conveyor belt 24 which is adapted to move the sleeves forwardly against the discharge gate 19 for uniform pick-up and delivery. When the lower portion of the centrally folded outermost sleeve is fully exposed, the shorter end is capable of being initially unfolded from the longer end and swinging downwardly upon impingement of an air jet issuing downwardly from a lineal air manifold 20 as shown in FIGS. 8 and 10. The manifold extends across the upper extremity of the opening of the holder 18 adjacent gate 19 in parallel vertical alignment with the outermost sleeve. Air pressure is maintained continuously on the manifold 20 during operation of the machine so that as the shorter end of each folded sleeve 12 is exposed to an outermost position, it is initially unfolded centrally by the lineal air jet to then be serially removed from the holder. Gate 19 is adapted to reciprocatable movement by operation of a piston operated interconnecting arm 19*a* and piston motor 21. The piston motor 21 may be either air or hydraulically operated. One vertical reciprocation of the gate allows one sleeve to be delivered to the air manifold.

A pair of pivotally-mounted vacuum cups V1 and V2 is mounted facing the holder 18 adapted to grasp the outer shorter upright end portion of the blown-open outermost sleeve. The vacuum cups serve to pull such end portion downwardly through an arc where it is then grasped by a pair of essentially-solid cylindrical nip rolls 22 and 23 mounted in juxtaposed relation parallel to and adjacent the delivery end of sleeve holder 18. Each of the vacuum cups V1 and V2 is mounted on a rotatable shaft, one being mounted on each side of roll 22 facing the outermost sleeve as shown in FIG. 11. The cups V1 and V2 are mounted in lateral alignment facing the sleeve adapted to pull it downwardly through an arc. The rotary shaft is reciprocatably operated by a piston motor in timed relation as shown in FIGS. 8, 10 and 11.

The upper roll 22 is adapted to contact the unfolded shorter end portion of the sleeve and is preferably larger than the lower roll 23. The smaller lower roll 23 has an imperforate cylindrical surface and is preferably fabricated of resilient material such as hard rubber. Upper roll 22 is preferably fabricated of metal so that the pair of rolls may firmly grasp the sleeve end portion. When the rolls 22 and 23 are driven in synchronism at the same rate of rotation, the sleeve is pulled between the rolls from the holder 18 after being partially unfolded by air manifold 20 and vacuum cups V1 and V2. As stated, a continuously-moving conveyor belt 24 is mounted beneath sleeve holder 18 to ensure that the stacked sleeves are continuously moved forwardly toward the delivery end of the holder during operation of the machine.

SLEEVE SPACING AND RETENTION

Rolls 22 and 23 are adapted to work together in tangential contact as a pair of nip rolls to engage the unfolded end portion of individual sleeve 12 therebetween and pull the sleeve from the magazine holder. The sleeves are thus able to be pulled from the holder serially and successively. The sleeves are then fed one-by-one onto an inclined positioning and spacing conveyor 25 still in flattened condition, i.e., with the gusseted side folds 12*a* still intact, but with central fold 12*b* unfolded. The sleeves 12 are fed up the inclined spacing conveyor 25 in spaced alignment, each being moved by a pair of upright chain-driven fingers 26 mounted in spaced-apart aligned relation on a pair of chains 27 on each side of the conveyor as shown in FIGS. 8 and 9. The fingers 26 contact the trailing edge of each sleeve after its leaving the rollers as shown in FIG. 12.

Figure 5:
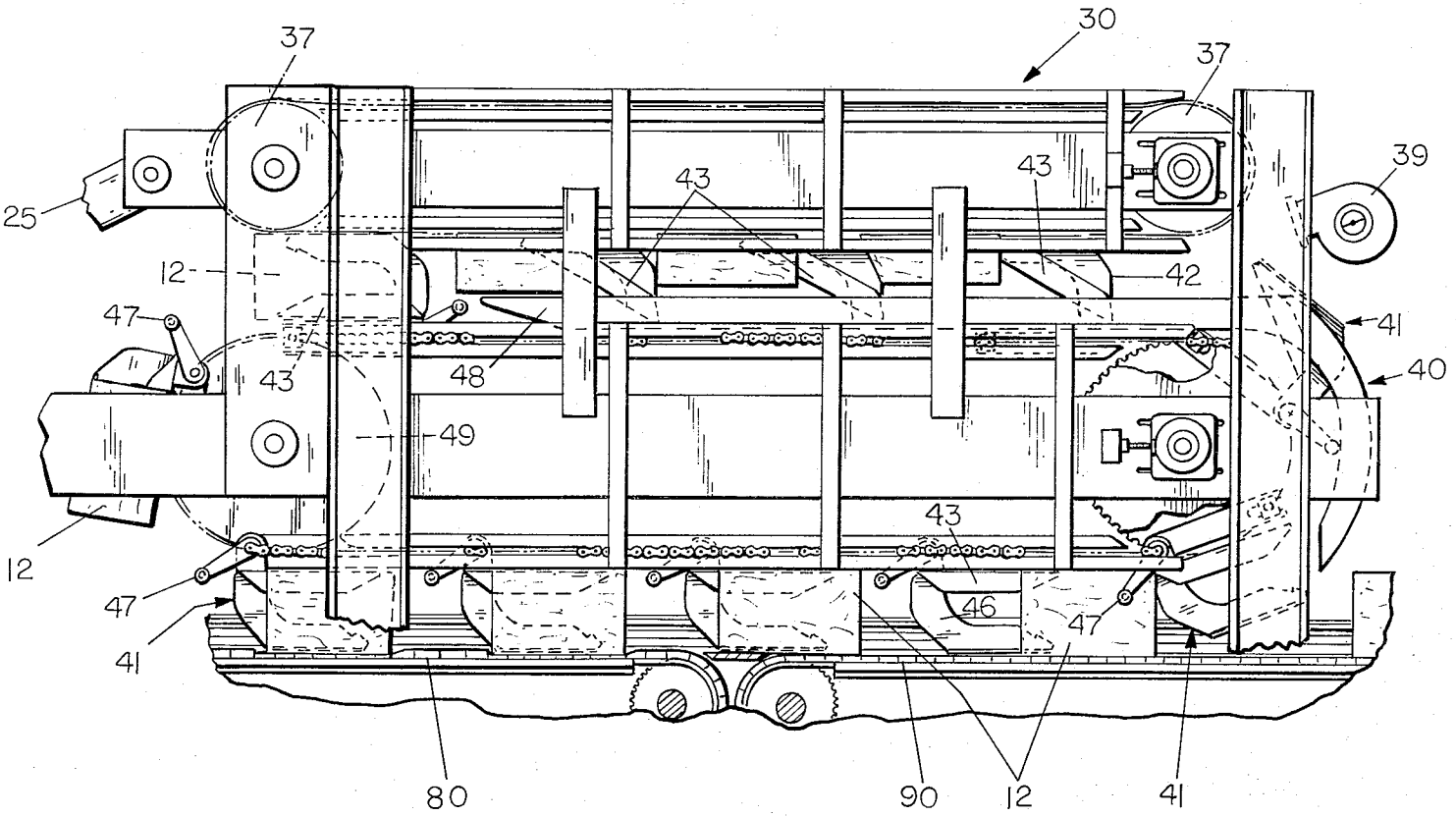
FIG. 5 is a further enlarged fragmentary side view of the upper portion of the machine shown in FIG. 1.
Figure 13:
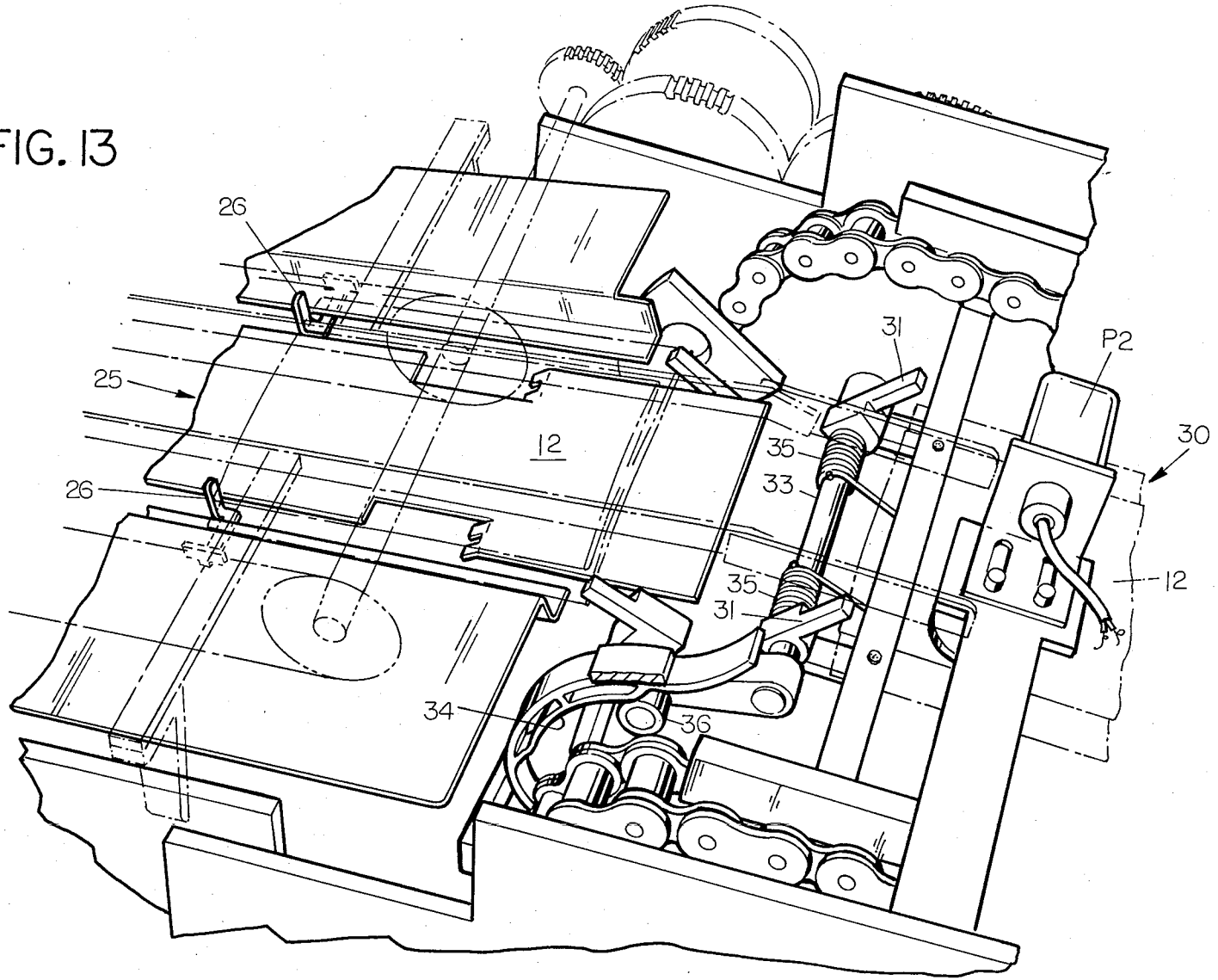
FIG. 13 is an enlarged fragmentary perspective view of the upper end of the sleeve spacing and transporting mechanism and inlet end of the sleeve retention mechanism.

The sleeves are moved in flattened condition resting on the stationary flat surface 28 of the conveyor 25 between the chains 27 while conveyed beneath a pair of parallel stationary rails 29 which hold the still-folded sleeves in oriented flat relation. Thus the flattened sleeves 12 are moved continuously upwardly in uniformly-spaced, axial alignment to be further opened after passage over uppermost horizontal chain conveyor 30 as shown in FIGS. 5 and 13. During the initial transportation of the sleeves, the gusset folds 12*a* along the sides of the sleeves are maintained intact while the sleeves are properly spaced for precisely timed delivery and subsequent opening. A photocell P1 is mounted above the inlet side of conveyor 25 to ensure that the individual sleeves are fed successively onto the spacing conveyor as shown in FIG. 8.

The upper conveyor 30 moves the sleeves till in flattened condition over its upper reach horizontally parallel to and in the same direction as the group 13 of aligned bottles 11 which are moved therebeneath. Pairs of spaced-apart retention fingers 31 and 32 are chain driven the length of upper conveyor 30 to grasp and transport the sleeves the full length of this conveyor. The pairs of fingers 31 and 32 are spaced apart so that they positively grasp and retain the sleeve wider bottom portion 12*d* at both ends and on each side of the sleeve, i.e, at all four corners. The fingers 31 and 32 are spring-loaded with each pair mounted on a common rotatable bar 33 so that they are cammed open by cam track 34 as the sleeves are delivered onto the incoming end of upper horizontal conveyor 30 from inclined spacing conveyor 25, and then closed by springs 35 to grasp juxtaposed sides of the sleeve bottom portion 12*d* having the wider transverse extent. A cam follower 36 mounted on one end of rotatable bar 33 serves to contact cam track 34 and rotate bar 33 and thereby open and close the pairs of sleeve retention fingers 31 and 32 at the inlet side of conveyor 30. Each flattened sleeve 12 has its full bottom portion 12*d* lowermost during its travel along the upper reach of uppermost conveyor 30 held in firmly clamped arrangement.

Figure 14:
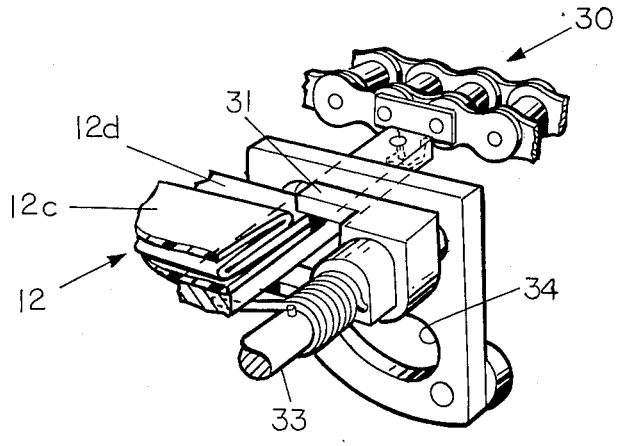
FIG. 14 is a fragmentary perspective view of one end of the sleeve gripping finger mechanism of FIG. 13.
Figure 15:
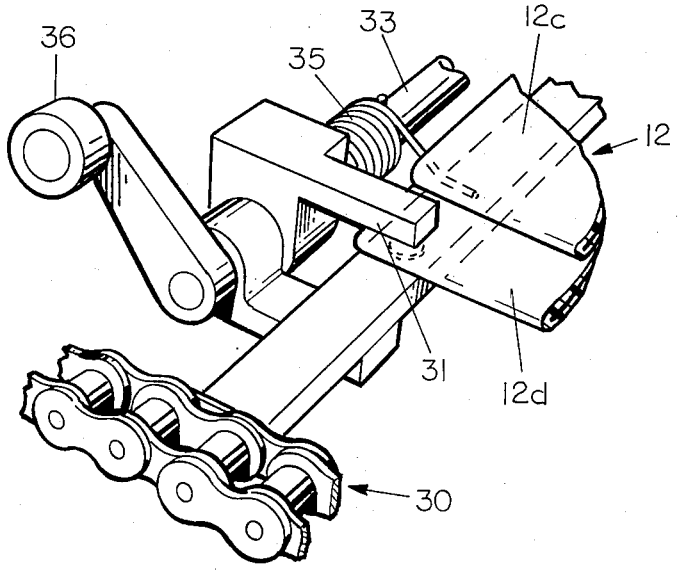
FIG. 15 is a fragmentary perspective view of the other end of the sleeve gripping finger mechanism of FIG. 13.

FIG. 14 indicates one end of the rotatable bar 33 having an individual grasping finger 31 thereon adapted to retaining one exposed edge of the sleeve bottom portion. FIG. 15 indicates the other end of the bar 33 and finger 31 grasping the sleeve edge as well as the cam follower 36 adapted to be moved within cam track 34.

Figure 16:
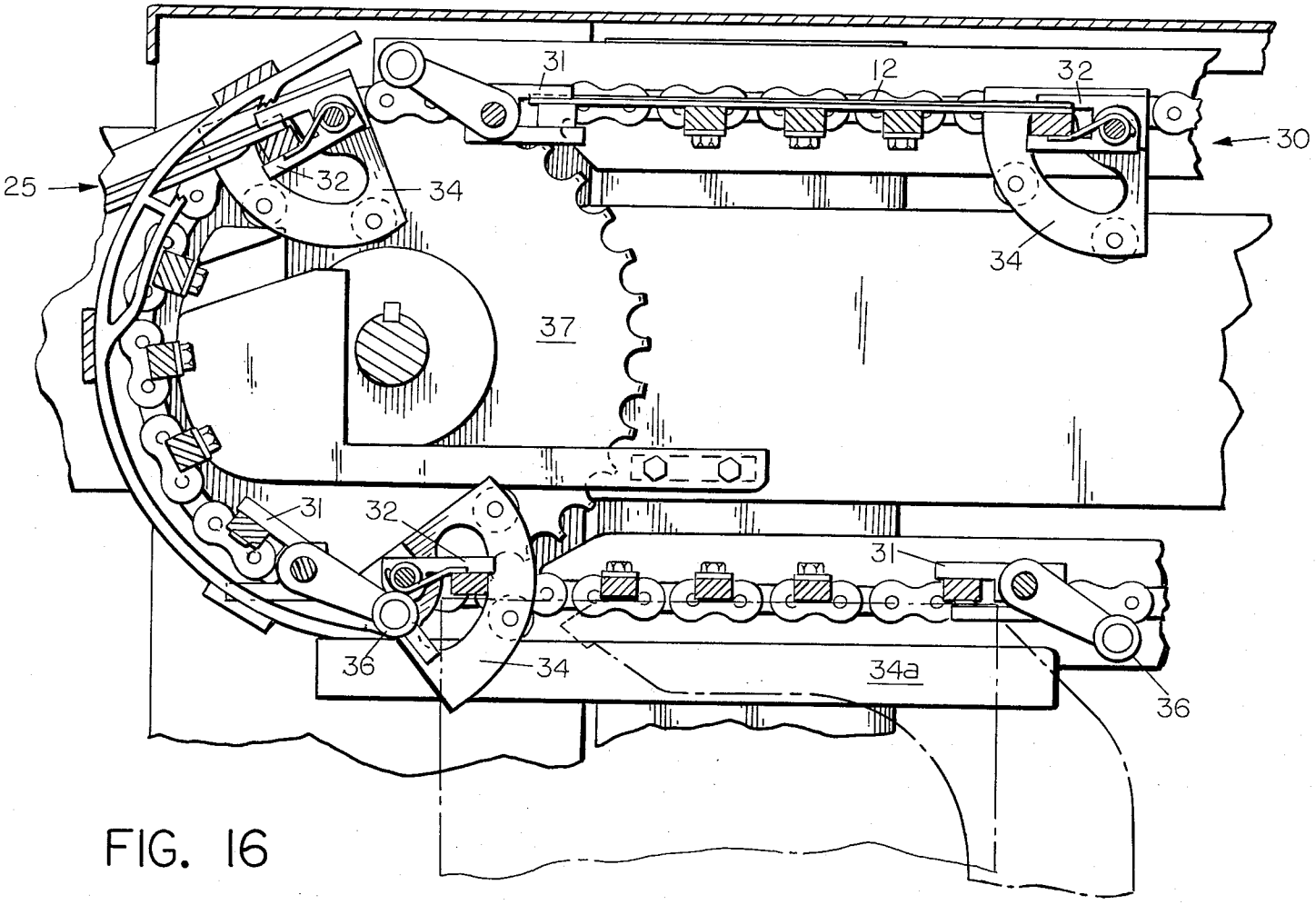
FIG. 16 is a fragmentary vertical sectional view of the inlet end of the sleeve retention mechanism as shown in FIG. 13.

FIG. 16 shows in greater detail the pairs of fingers 31 and 32 holding opposing ends of sleeve 12 during its travel across the upper reach of conveyor 30. The camming mechanism 34*a*, utilized to cam open the individual fingers for sleeve release, are shown on the lower side of the conveyor to facilitate release of the sleeves onto shoe conveyor 40. The mechanisms to close the fingers to firmly retain the sleeves are shown on the upper side of conveyor 30.

Thus, the sleeves are positively held at their sides and near both ends, i.e., at all four corners, as they are conveyed horizontally in uniformly-spaced relation across the upper reach of conveyor 30. A second photocell P2 is located at the inlet side of conveyor 30 to ensure that sleeves are successively received and retained. The sleeves are similarly held during their conveyance through an arcuate path at the end of the upper reach of horizontal conveyor 30. The sleeves move through an arcuate path when chain-driven fingers 31 and 32 are moved around the pair of sprockets 37 at the right-hand end of conveyor 30 as shown in FIG. 5. At that time, the gusset folds 12*a* of the sleeve tend to separate by gravity with the top panel 12*d* dropping downwardly away from restrained bottom panel 12*d* effecting a partial opening.

SLEEVE OPENING

As shown in FIG. 5, air blower 39 is mounted below the vertical center and facing the horizontal axis of sprockets 37 of conveyor 30 adjacent the conveyed sleeves adapted to blow each sleeve 12 further open during its arcuate travel as top and bottom panels 12*c* and 12*d* respectively are inverted and tend to separate due to gravity. As the sleeves are conveyed further on the underside of conveyor 30, they are still retained at the corner regions of bottom panel 12*d* by retention fingers 31 and 32 while held partially open.

A next adjacent conveyor 40 is mounted immediately below and parallel to upper conveyor 30 having a comparable width and lineal extent. Conveyor 40 has a series of operable hollow shoe elements 41 mounted thereon in spaced-apart relation. Each shoe element 41 has a printed hollow rigid portion 42 having a T-shaped cross-section adapted to penetrate an individual sleeve 12 in its partially open condition while held by the four corners of bottom portion 12*d* on upper conveyor 30. At this time, the sleeve is conveyed in inverted relation on the underside or lower reach of upper conveyor 30. Each shoe element has a pivotally-mounted extendable portion 43 adapted to cooperate with the rigid portion 42 to fully open the sleeve 12 when internally disposed and pivotally extended.

The upper reach of conveyor 40 is adapted to travel faster in a lineal direction than the lower reach of conveyor 30 in timed relation thereto so that each rigid shoe element 41 is adapted to telescopically penetrate the major extent of each partially-open sleeve 12 as the shoe and sleeve are brought into coaxial and lateral alignment by their respective conveyors 30 and 40 moving at different speeds. At this time, the hollow rigid portion 42 of the shoe element of slightly-greater width penetrates the sleeve so that the upper region of its T-shape is closely adjacent the retained bottom panel 12*d* of an individual sleeve. Movement of the shoe elements on conveyor 40 is adapted to sequentially penetrate and open an individual sleeve 12 as shown in FIGS. 5 and 17.

Figure 17:
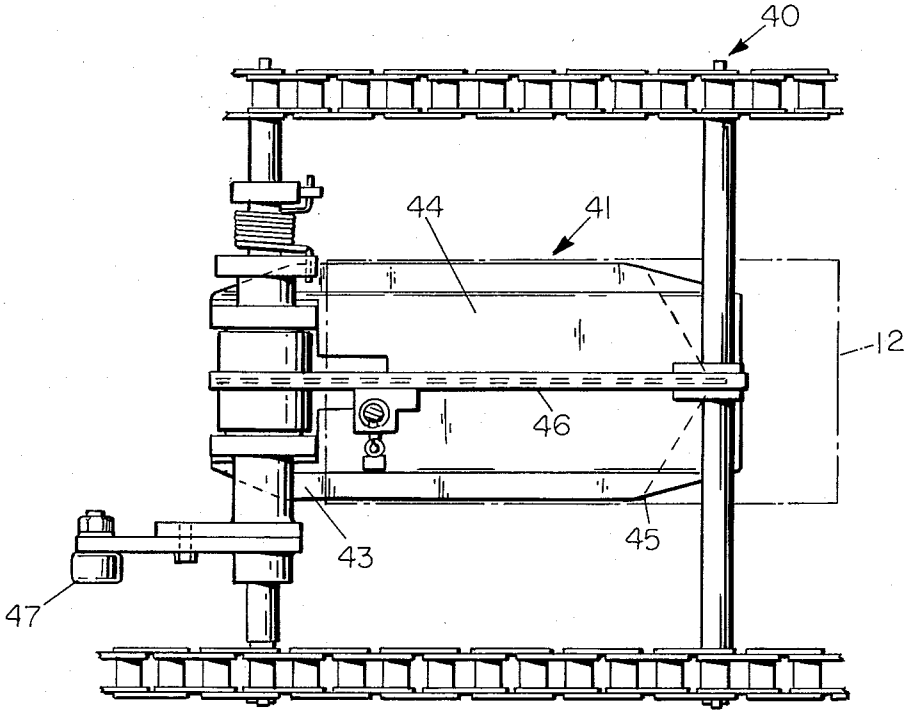
FIG. 17 is a fragmentary top view of the sleeve opening mechanism shown in a central region of FIG. 5.
Figure 18:
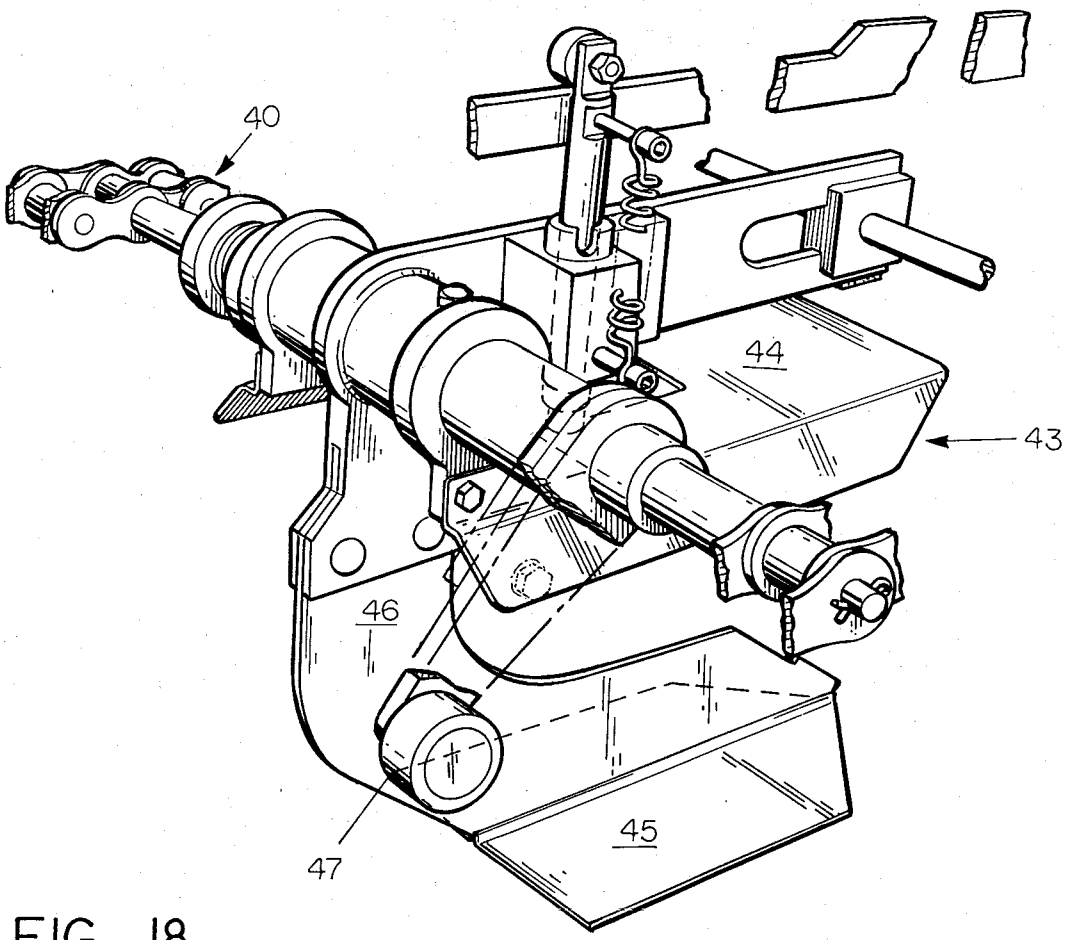
FIG. 18 is an enlarged fragmentary perspective view of the sleeve opening mechanism shown in FIGS. 5 and 17.

Each shoe element 41 has upper and lower panel segments 44 and 45, the former being connected to a central web 46 as shown in FIG. 17. Upper panel 44 which is part of rigid portion 42 has a width comparable to the sleeve bottom panel 12*d* and lower panel 45, which is part of pivotally-extendable portion 43, and has width comparable to the sleeve upper panel 12*c*. The sides of the sleeve are stretched between shoe upper panel 44 and shoe lower panel 45 when extendable portion 43 is moved away from T-shaped rigid portion 42 so that the gusset folds are fully opened. At this time, the sleeve 12 has its upper and lower panels 12*c* and 12*d* inverted.

Shoe element 41 initially penetrates the partially-open sleeve 12 during its more rapid conveyance therebeneath in coaxial alignment. Once the shoe element fully penetrates a partially-open sleeve and is in lateral alignment, the pivotally mounted, extendable portion 43 is moved downwardly through an arc by a cam follower 47 contacting cam track 48 to effect complete opening of the sleeve in a positively-controlled manner. When the sleeve is fully opened, having a generally-rectangular transverse cross-section upon reaching the left-hand end of the upper reach of intermediate shoe conveyor 40 as shown in FIG. 5, the open sleeve is conveyed through an arcuate path created by the shoe element 41 being moved around the sprockets 49 located above and in alignment with the input end of the bottle conveyor.

Just prior to reaching the left-hand end of conveyor 40 and extendable shoe portion 43 being extended, retention fingers 31 and 32 on conveyor 30 are rotated open by cam follower 36 contacting stationary cam track 34*a* to release the edges of the sleeve bottom panel 12*d*. As the sleeve in fully-open arrangement mounted solely on expanded shoe element 41 is moved through the arc of the conveyor end sprocket 49, it is brought down into coaxial alignment with the path of a group 13 of bottles 11 on horizontal bottle conveyor 52. The sleeve is thereby inverted into upright relation after being arcuately conveyed so that it is positively held open in generally rectangular, cross-sectional form by the T-shaped rigid portion 42 and extendable portion 43 to permit entry of the bottle group 13 into the fully-extended sleeve. Of the six-bottle grouping, three bottles are able to move into the sleeve on each side of the central web 46 of rigid portion 42.

BOTTLE HANDLING AND GROUPING

Figure 3:
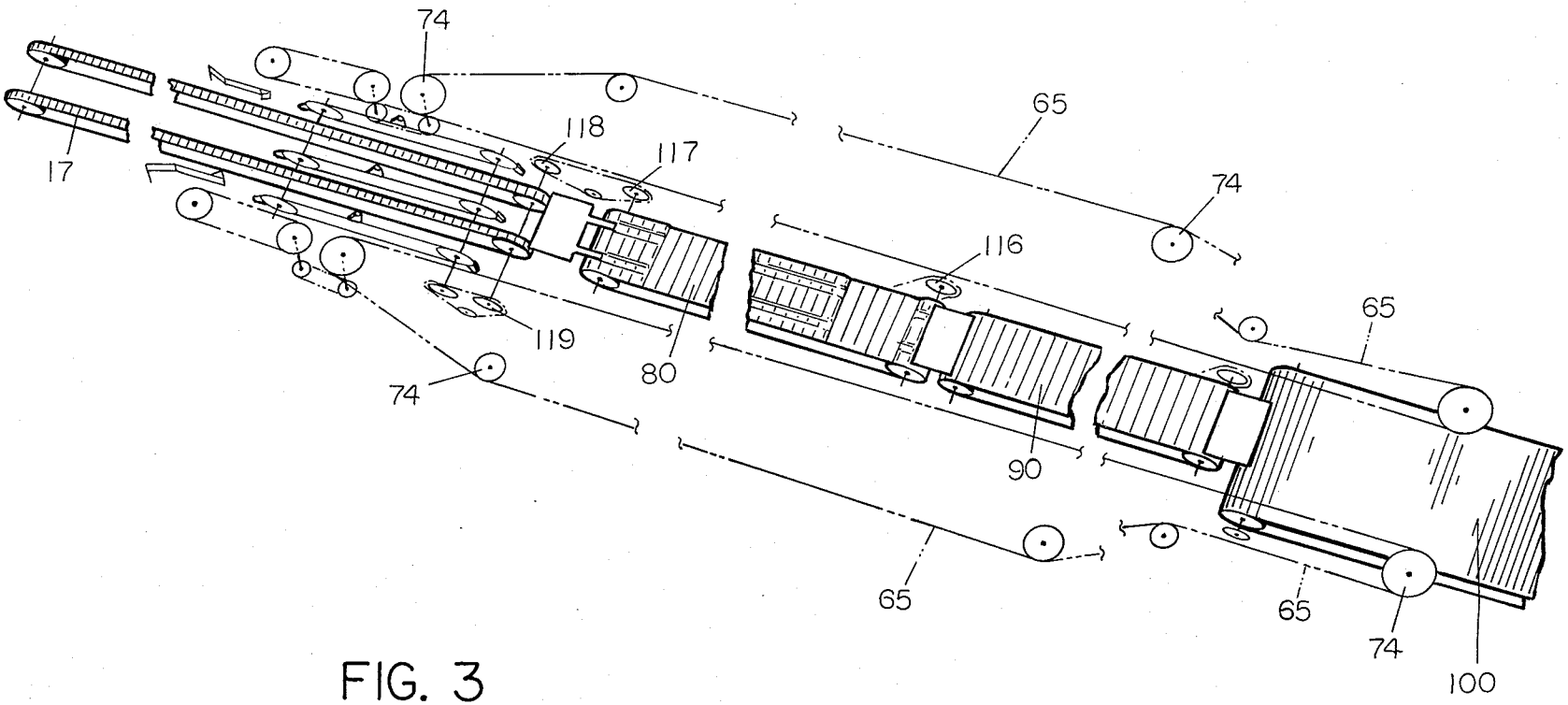
FIG. 3 is a schematic perspective view showing the main conveyor and chain mechanisms of the machine shown in FIGS. 1 and 2.
Figure 6:
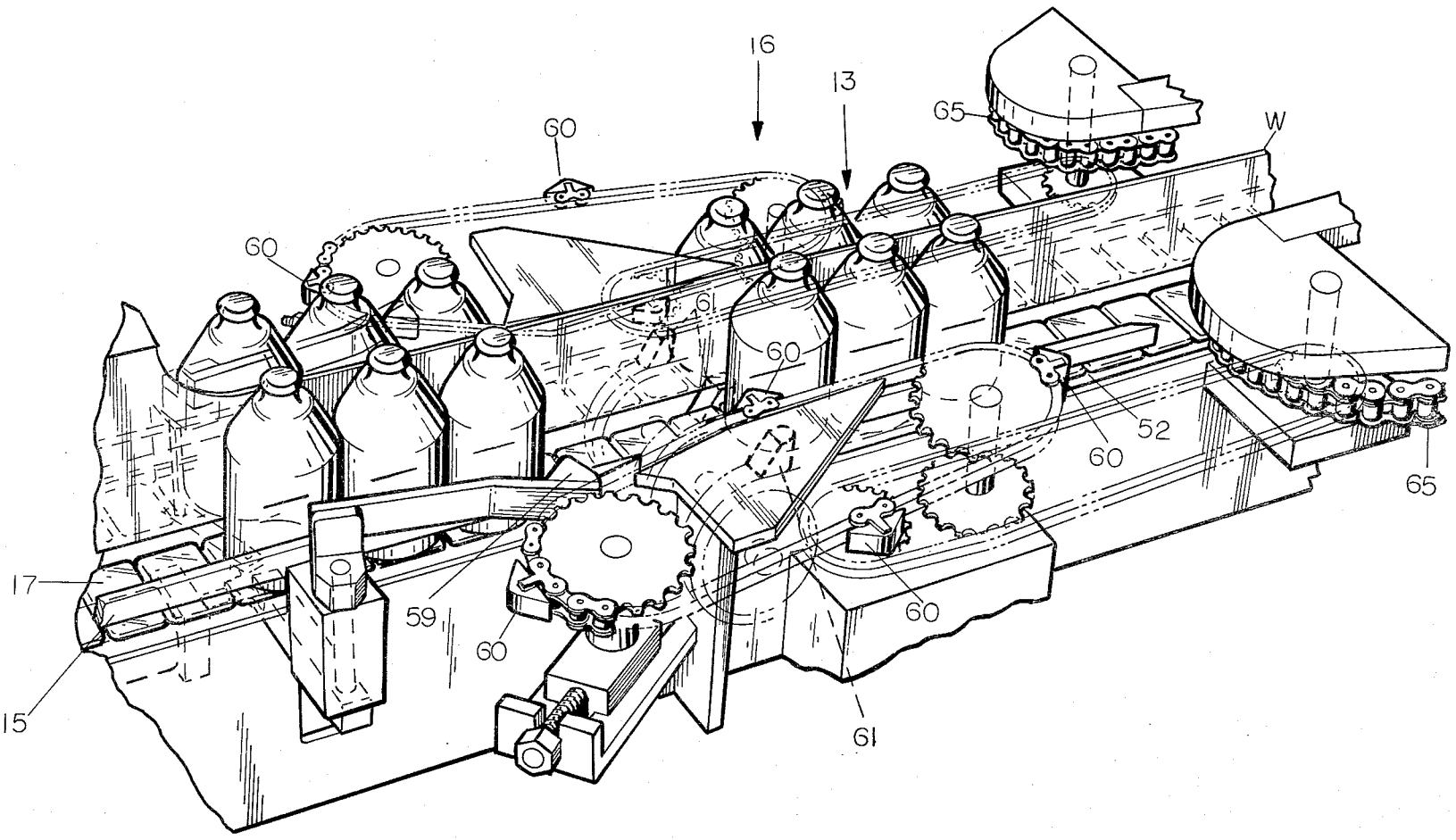
FIG. 6 is still a further enlarged fragmentary perspective view of the bottle grouping mechanism on the inlet side of the machine.

The bottles 11 are delivered to the vertical sleeve-applying machine 10 on horizontal aligned conveyor 14 as stated. Conveyor 14 is adapted to transporting the bottles from a single-line contacting relation to a double-line contacting relation with the bottles aligned tangentially in two rows. The bottles are fed forwardly by the infeed conveyor 17 in tangential engagement front-to-back in two isolated parallel rows for presentation to a pair of reciprocatable stop lugs 59. The side grouping lugs 60 are mounted on a pair of chains on opposing sides of the infeed conveyor with the latter having a greater lineal extent than the bottle group as shown in FIGS. 1, 3 and 6. The juxtaposed stop lugs 59 serve as an escapement mechanism to meter three bottles at a time simultaneously from each row. The grouping or metering lugs 60 which are chain driven are adapted to receive the six-bottle group from the stop lugs 59 when opened and are normally operated at a speed which is slower then the infeed conveyor 17 so that the lead bottle is restrained by the forward lug until a second spaced lug is introduced behind the third bottle to restrain the following bottles. Thus the grouped bottles are held together between the pair of moving metering lugs 60 and moved forwardly thereby along with the conveyor therebeneath.

At this point, as shown in FIG. 6, the forward grouping lugs 60 are radially swept around their respective sprockets which action releases the first three bottles in each row, permitting the released grouped bottles to accelerate to the speed of the second infeed conveyor 52 which further separates the six bottles from the incoming supply.

Figure 7:
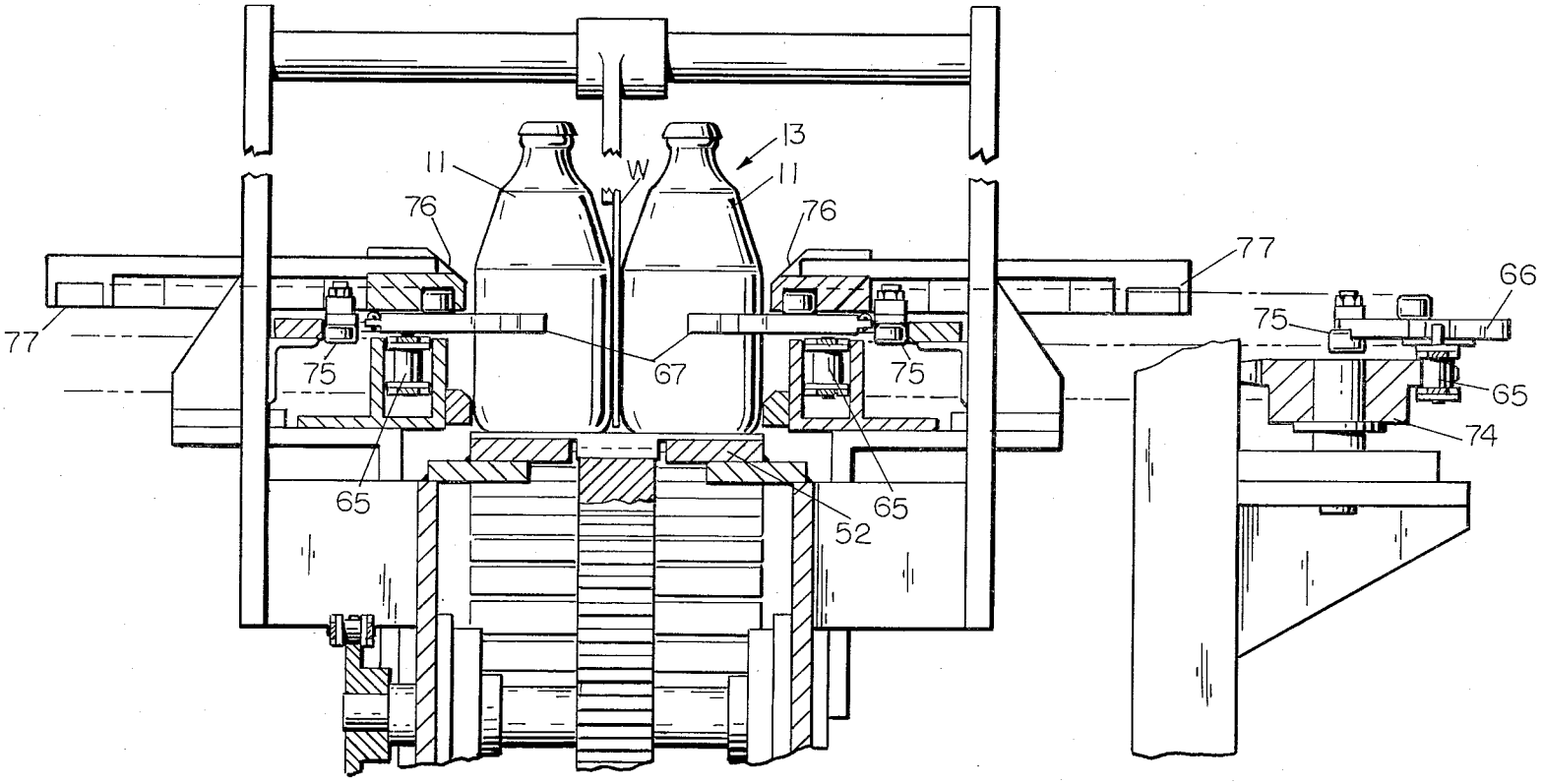
FIG. 7 is a fragmentary transverse vertical sectional view taken substantially as indicated by the line A—A on FIG. 1.

At the instant of release of the grouped bottles from the side grouping lugs 60, three vertically-projecting chain-driven pins 61 are raised into the path of the bottle travel immediately behind the trailing bottle in each row of three bottles. As seen in FIG. 6, the three pins are equi-spaced so that a pair of pins contacts an individual trailing bottle 11 of the aligned two bottle pairs. The vertically-projecting pins 61 on this intermediate spacing chain are arranged to travel faster than the bottles on the second infeed conveyor 52 so that they eventually catch up to and forcefully move ahead the trailing bottle in each row. When the pins engage the trailing bottles, they accelerate the three containers in each row to the speed of the intermediate spacing chain carrying lugs 60 and space them as a group 13 in proper timed relationship to be engaged by the insertion finger chains 65. The horizontally-traveling, opposed insertion finger chains 65 located on opposing sides of the infeed conveyor each carry multiple juxtaposed pairs of fingers 66 and 67. The trailing finger 67 of each group of two on each chain 65 is used to engage the last bottle in each row of three bottles, and the forward finger 66 engages the leading bottle of each row in the bottle group. A stationary vertical central web W is mounted between the bottle rows as shown in FIGS. 6 and 7 to assist in maintaining the rows precisely aligned during their transport over conveyors 17 and 52 while held within the side rails 15.

As the three containers in each row are presented to the insertion finger chains 65, the trailing fingers 67 are cammed into the line of bottle travel and, since such chains travel at a higher speed than the intermediate spacing chain carrying lugs 60, they eventually catch up to the trailing bottle in each row and accelerate the group of six bottles to the speed of the pairs of juxtaposed insertion fingers 66 and 67 mounted on chains 65. At this point, the forward finger 66 which is pivoted is released from its cam 68 to permit this spring-loaded finger to engage the forward bottle in each group thereby trapping and restraining the three bottles between the two fingers. In this manner, the bottles are transferred from the second infeed conveyor 52 across a deadplate and onto the bilevel conveyor 70. After the transfer of the assembled bottles is accomplished to the bilevel conveyor, the forward finger 66 is released to swing away from the leading bottle to permit insertion of the bottles into the sleeve which has been introduced into the line of bottle travel in an open position. The front finger 66 is again actuated after the bottles are inserted to the proper depth in the slower moving sleeve 12 held by conveyor 40 to clamp the sleeve between the front fingers and the lead bottle in each row. When clamping is accomplished, the assembled package is stripped from the slower moving sleeve support shoe 41 onto a third bilevel conveyor 80 traveling at the same speed as the insertion finger chains 65. The package is then transferred across a deadplate to a fourth smooth-surfaced conveyor 90 and then to the shrink tunnel roller conveyor 100 while still clamped by the insertion chain fingers 66 and 67 where it is then released for transport through the shrink tunnel.

A detector head (not shown) is located at the grouping point 16 as indicated in FIGS. 1 and 6 to be certain that a group 13 of six filled and capped bottles 11 is present in proper alignment for wrapping. The detector head has six individual detecting elements each positioned over and above in vertical alignment with the six aligned bottles disposed in stationary double-row array to ensure that all bottles are present and suitably capped ready for wrapping. Unless a complete six-pack group of bottles is indicated as present and ready for wrapping, the group is not released from point 16 to be combined with an open tubular sleeve.

As the open sleeve 12 held open by hollow shoe element 41 is moved into alignment with bilevel conveyor 80 immediately preceding bottle group 13, the bottles are released from grouping point 16 and moved at a faster lineal speed by second infeed conveyor 52 and then over aligned bilevel conveyor 80 to catch up with an enter the trailing open end of tubular sleeve 12. Hollow shoe element 41 and its central web 46 are designed to permit entry of the six bottles in two rows of three each on each side of the web while holding the sleeve fully extended in tubular form.

The central region 80*a* of the conveying surface of bilevel conveyor 80 is slightly depressed or recessed to permit the panel portion 44 of shoe element 41 to fit therewithin while conveying the grouped bottles and surrounding sleeve. The bottles are deposited within a central region of the sleeve, initially onto the wider bottom panel 44 of internal shoe element 41 so that an equal length of sleeve overhang exists at each end of bottle group 13. The recess in the conveyor upper surface permits moving the bottles in upright relation onto panel 44 while surrounded by the sleeve without excessive displacement of the bottles out of tangential contact.

Figure 19:
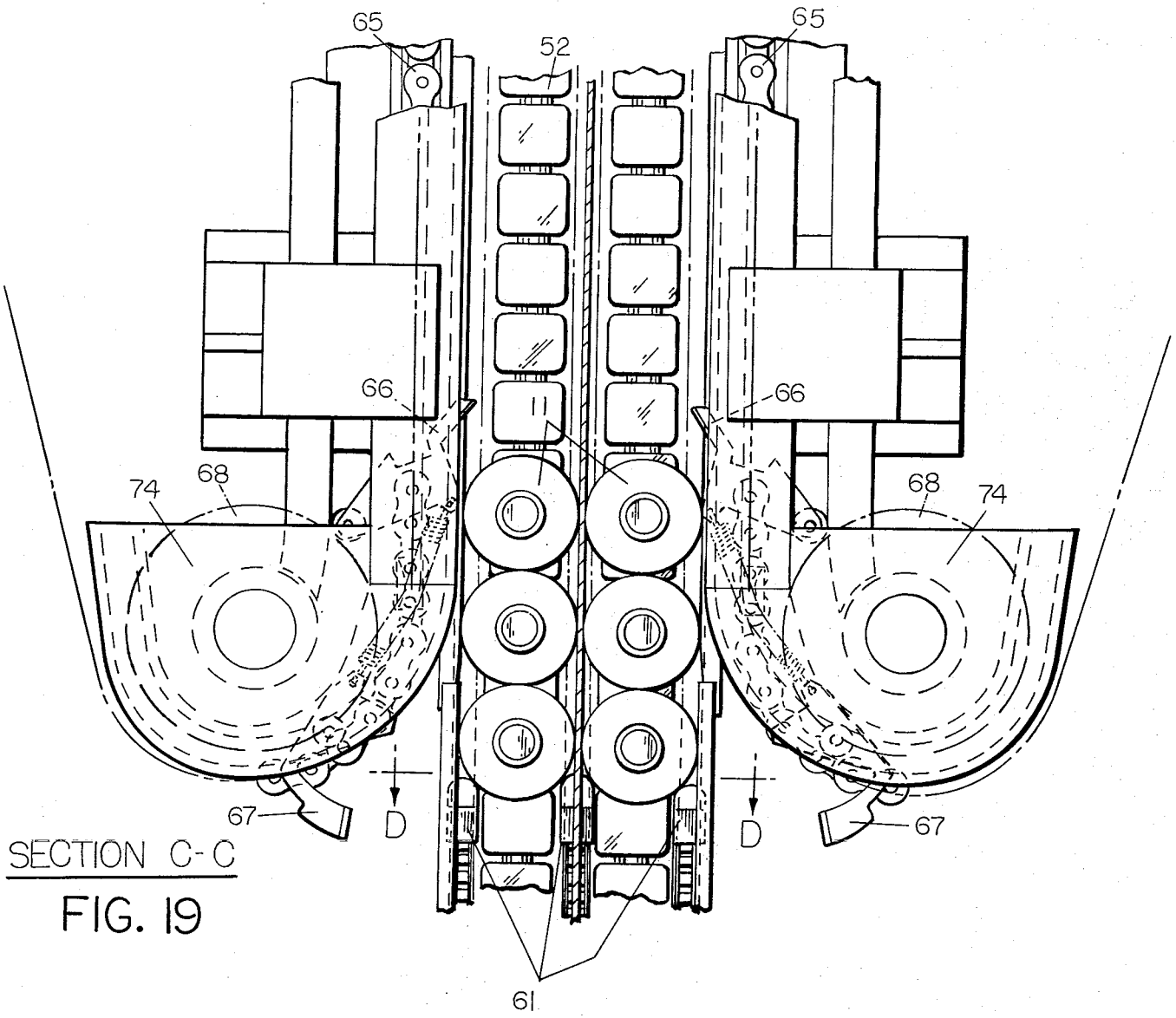
FIG. 19 is a fragmentary horizontal sectional view of the assembled bottle group on the primary conveyor substantially as indicated by the line C—C on FIG. 1.
Figure 22:
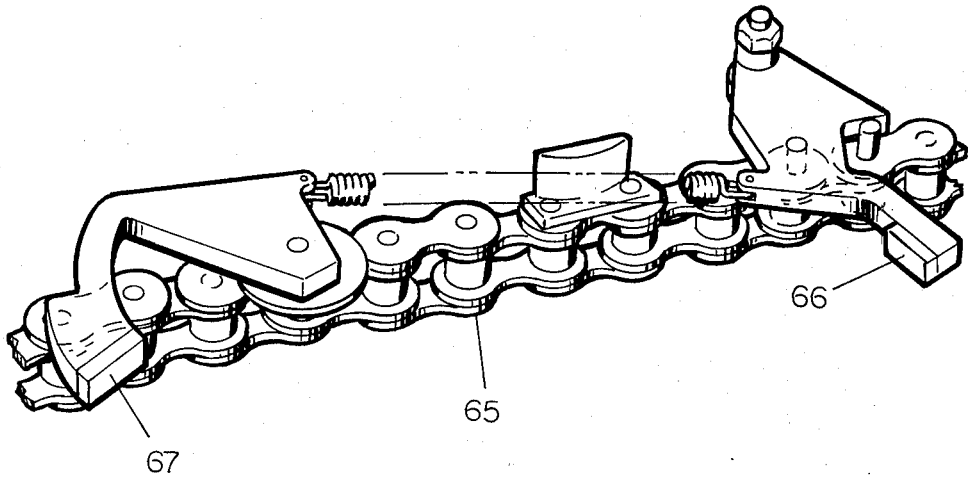
FIG. 22 is a still further enlarged fragmentary perspective view of one pair of insertion fingers and conveying chain along one side of the primary bottle conveyor.
Figure 20:
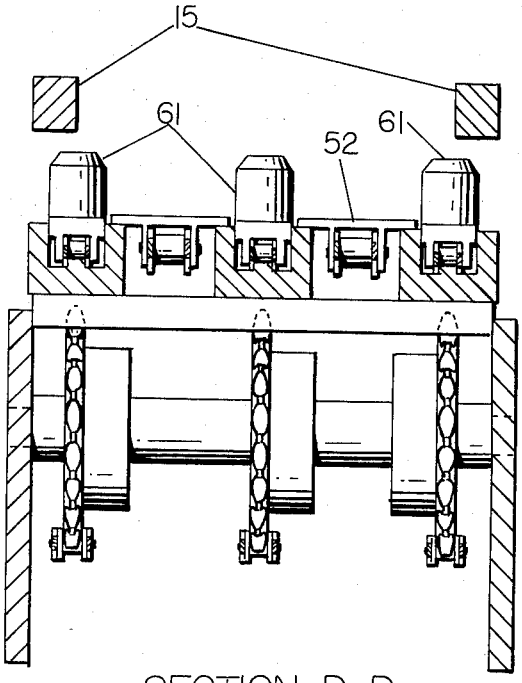
FIG. 20 is a fragmentary vertical sectional view substantially as indicated by the line D—D on a central portion of FIG. 19.
Figure 21:
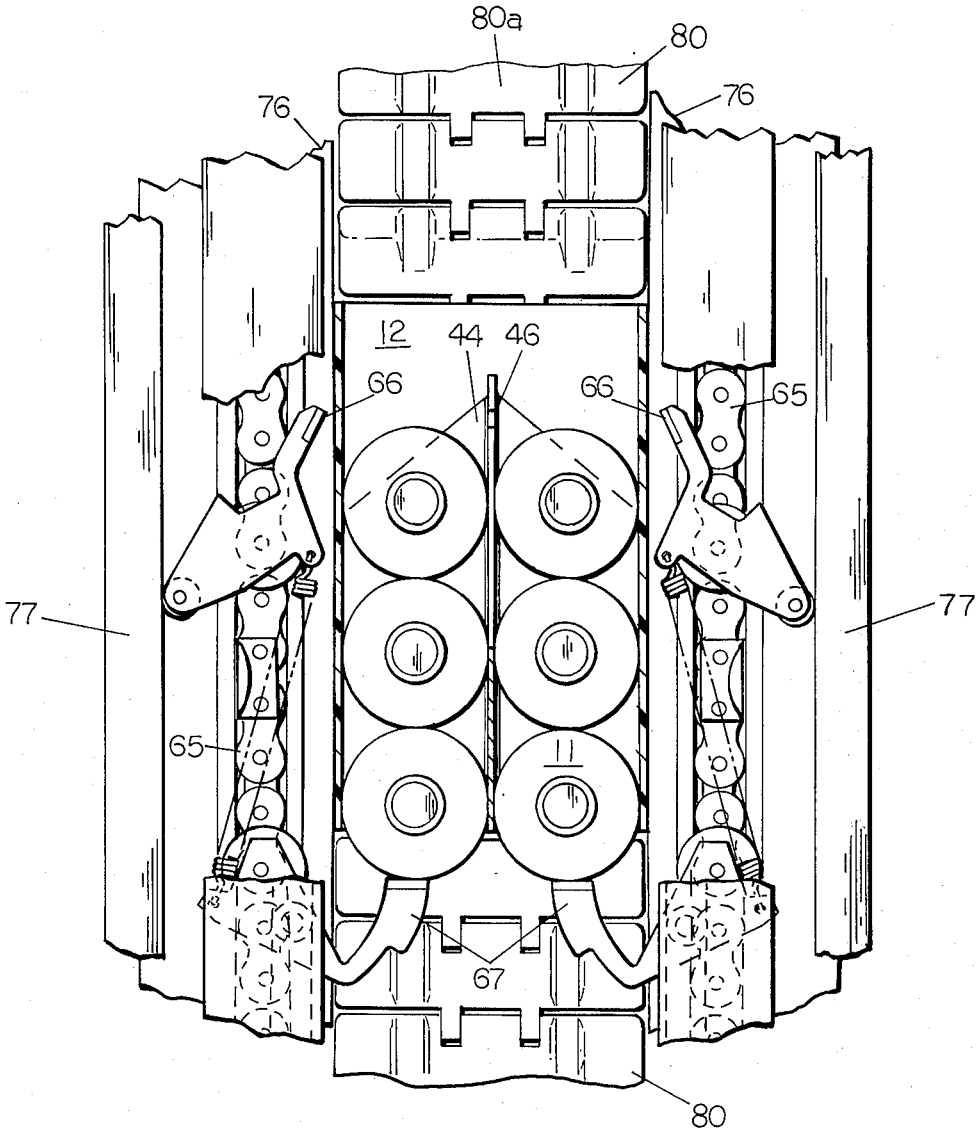
FIG. 21 is a fragmentary horizontal sectional view generally similar to FIG. 19, substantially as indicated by the line E—E on FIG. 1.
Figure 23:
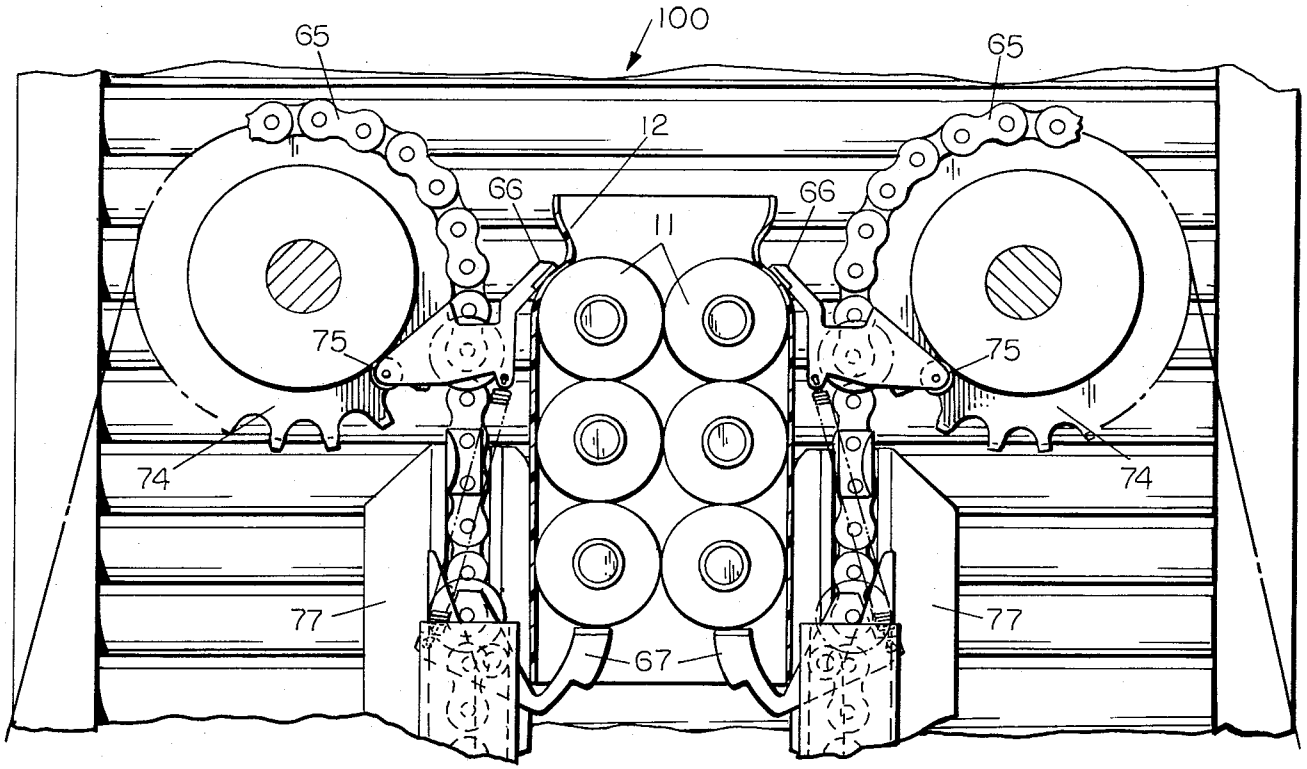
FIG. 23 is a fragmentary horizontal sectional view, generally similar to FIGS. 19 and 21, substantially as indicated by the line F—F on FIG. 1 at the outlet end of the sleeve-applying machine.
Figure 24:
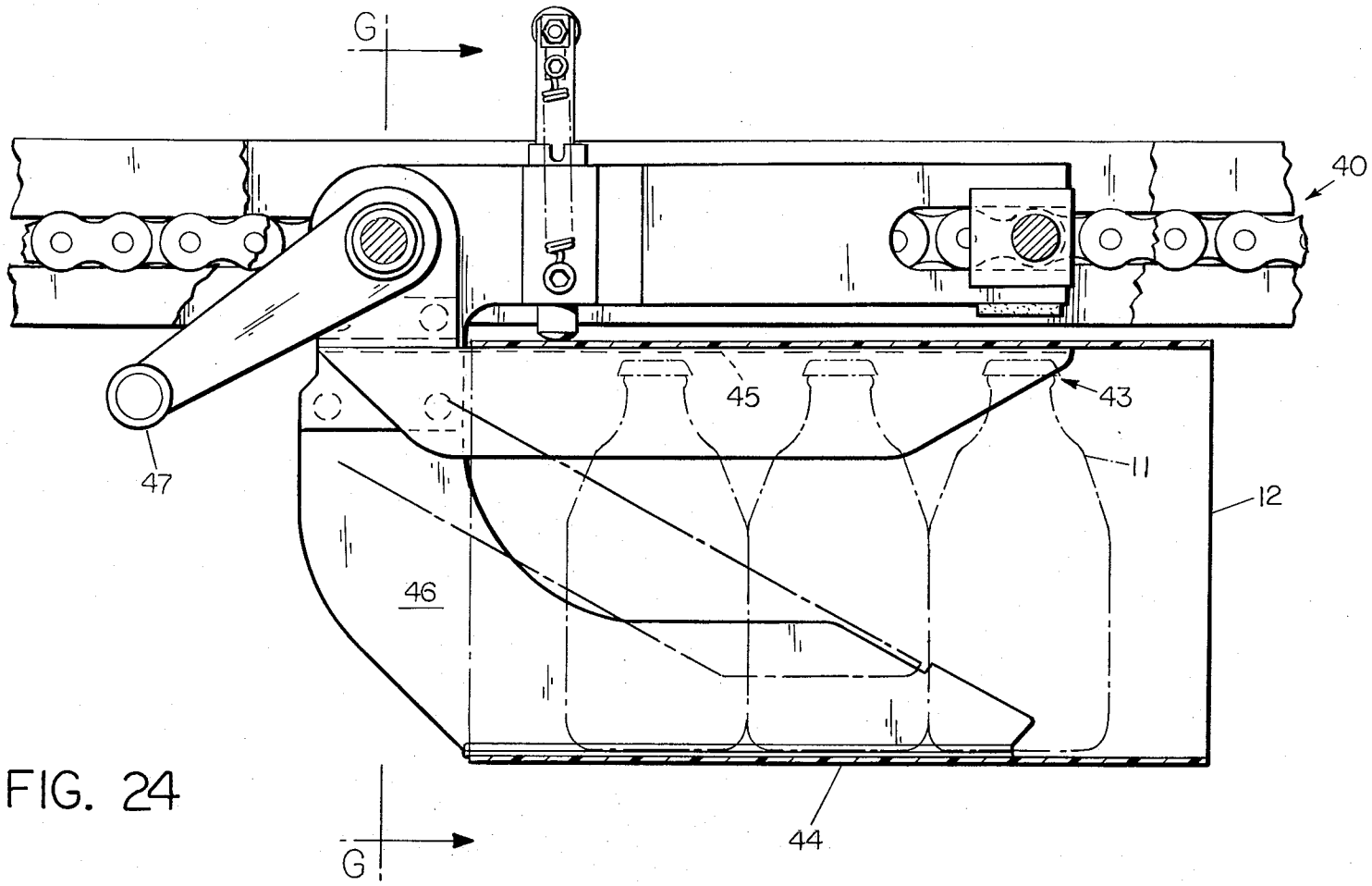
FIG. 24 is a further enlarged fragmentary vertical sectional view of the sleeve opening mechanism shown in FIGS. 17 and 18.
Figure 25:
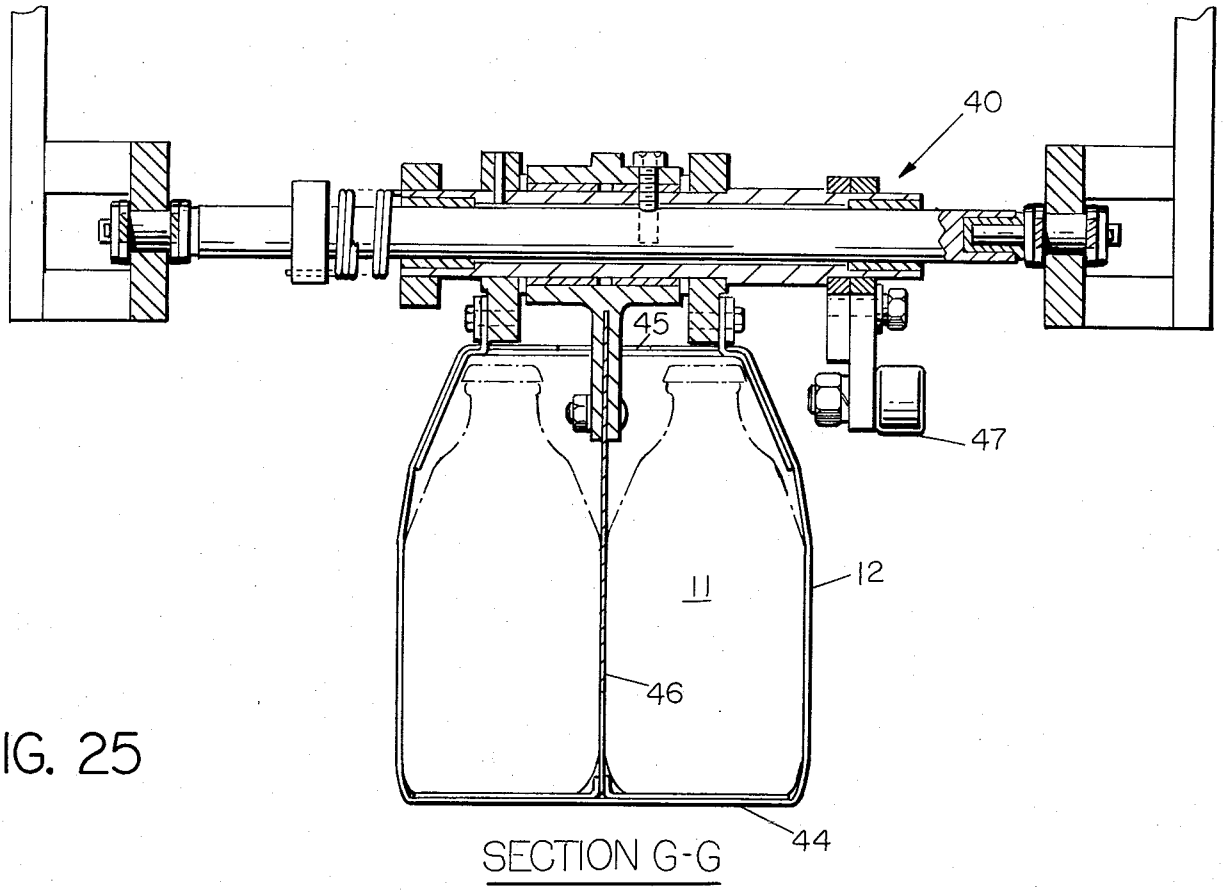
FIG. 25 is a transverse vertical sectional view of the sleeve opening mechanism substantially as indicated by the line G—G on FIG. 24.

As stated, bottle group 13 is moved along bilevel conveyor 80 by both the conveyor upper surface and pairs of insertion fingers 66 and 67 mounted on endless chains 65 which parallel both sides of the conveyor. The pair of finger elements 66 and 67 is located in spaced alignment overlying bilevel conveyor 80 to contact the trailing bottles of each bottle group 13 as shown in FIGS. 19 and 21 to maintain the group in tight surface-to-surface contact during their conveyance. The insertion finger chains 65 are operated to move faster than bilevel conveyor 80 to cause the bottle group 13 to be moved into an individual sleeve while held fully open by shoe 41.

The pivotally-mounted insertion fingers 67 are adapted to directly contact the trailing bottles 11 by extension through the trailing open end of the sleeve 12 during the introduction of bottle group 13 into the surrounding sleeve. The pair of finger elements 66, which are located transversely on chains 65 just ahead of fingers 67, is adapted to pivotally close to retain the leading bottles 11 of group 13 through the sleeve 12 so that the two pairs of pivotal fingers 66 and 67 positively restrain the trailing and leading bottles respectively against vibration and resulting separation while the bottles and sleeve are moved forwardly simultaneously as a unit. The moving bottles are thus retained by four-point finger pressure, i.e., through the flexible sleeve on the leading side and in direct contact with the bottle surfaces on the trailing side.

Chains 65 are mounted on a series of horizontal sprockets 74 so that one reach of each chain extends adjacent and slightly above conveyors 52, 80 and 90 on opposing sides thereof. Chains 65 extend throughout the length of conveyors 80 and 90 as shown in FIG. 3. Fingers 66 and 67 are pivotally mounted in spring-biased horizontal relation on chains 65 so that they may be cam operated. A cam follower 75 is mounted on the outboard side of each pivoted finger 66 and 67 operable within a cam track 77 to move the respective fingers into and out of bottle retention position. As stated, when the bottle group 13 is initially conveyed along conveyor 80, the rearward fingers 67 are moved into bottle conveying position contacting the trailing bottles. After the bottles are moved into a central region of sleeve 12, the forward fingers 66 are cammed over the conveyor to contact the sleeve 12 and retain the leading bottles within the sleeve. The bottles are then conveyed further by smooth-surfaced conveyor 90 while held by the four fingers moving in conjunction with the conveyor 90. Conveyor 90 and chains 65 are operated at the same lineal speed.

Since the shoe element 41 is moving horizontally more slowly than the bottles and is conveyed upwardly through an arc by shoe conveyor 40 upon separation from the bottles and their surrounding sleeve, the shoe element is moved upwardly away from conveyors 80 and 90 leaving the bottles retained within the sleeve. The bottles firmly retained by the fingers and surrounded by the sleeve are then transported to the end of conveyor 90 to pass onto the aligned roller conveyor 100 of the tunnel oven for heat shrinking.

As the bottles leave conveyor 90, they are still maintained in tight tangential contact within the sleeve between the parallel side rails 76 on both sides of the conveyor. The side rails extend a short distance over and above interconnecting aligned conveyor 100 of the shrink tunnel oven to maintain bottle alignment within the sleeve during transfer of the package from one conveyor to another. Conveyor 100 preferably operates at a slower speed than conveyor 90 to permit uniform bottle package passage through the tunnel oven where the sleeve is heated and substantially contracts around the grouped bottles. Hot air is blown against the exterior surfaces of the sleeve 12 within the oven to obtain maximum shrinkage of the sleeve during its transport therethrough. Temperatures of the oven may vary from about 170° F. to 800° F., depending upon the selected thermoplastic sleeve material. A preferred temperature for the coextruded film and foam polyethylene material is about 500° F. throughout the central region of the oven, although a preferred range is from about 475° to 525° F.

Shrink tunnel conveyor 100 is arranged to operate at a speed sufficiently-high to process the maximum number of packages per minute which the sleeve-applying machine can suitably form. The speed of the sleeve-applying machine is determined by the backlog of bottles accumulated in front of the infeed conveyor and the sleeve applicating machine.

In response to three switches sensing this advance accumulation, the machine will be placed in either a high, medium or low range of speed. The effect of these speed changes results in the loosely-formed packages being introduced to the shrink tunnel conveyor at a variety of speed levels. In order to minimize bottle displacement or separation of the group within the sleeve at the time of transfer of the package to the constant lineal speed shrink tunnel conveyor 100 which is comprised of a series of rollers, a synchronizing belt is employed to engage the bottom side of the conveyor rollers for a limited distance on the inlet side to rotate the rollers in a manner to equalize the speed of the package with the peripheral speed of the rollers in that limited section of the conveyor where the packages are released from the insertion finger chains. This mechanism is mechanically coupled through a differential to automatically change the synchronizing belt speed to control the roller speed when the speed of the sleeve-applying machine is altered.

Figure 26:
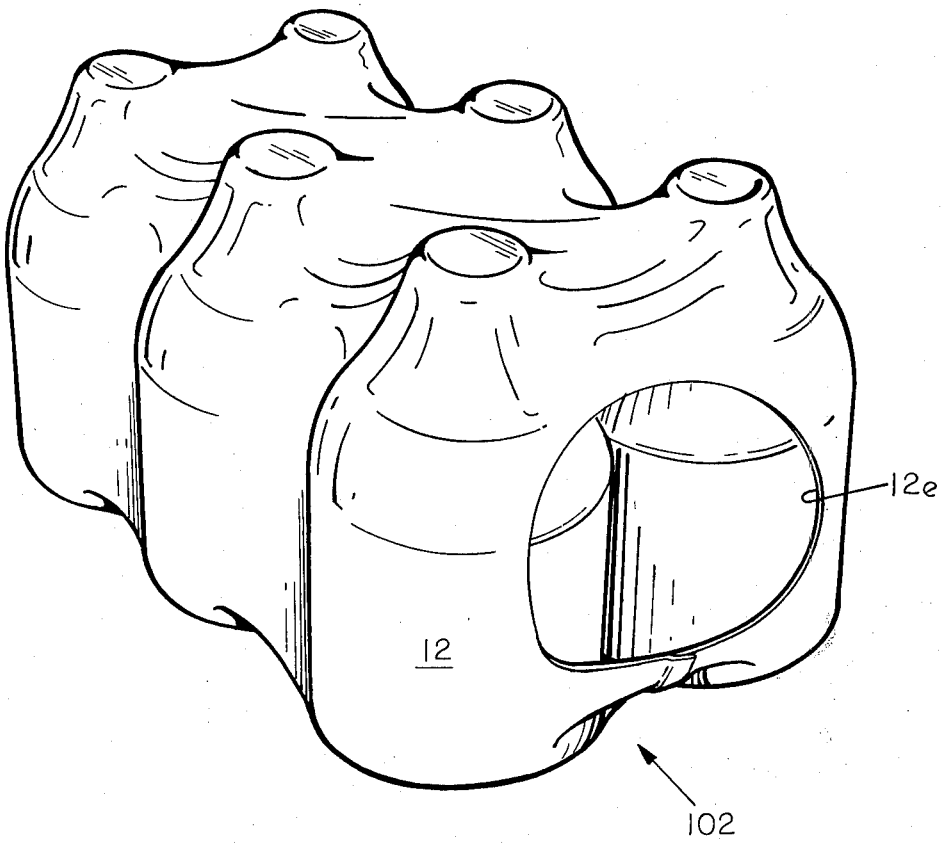
FIG. 26 is a perspective view of the package of assembled bottles tightly restrained within a heat-shrunken sleeve.

After entry into and continuous passage through the heated tunnel oven, the packages are then cooled for immediate loading into cartons or trays for shipment. Each of the wrapped groups of bottles constitutes a tight durable package 102 as shown in FIG. 26 in which the individual bottles are firmly restrained against relative movement by the shrunken sleeve. The package 102 has elliptical openings 12*e* at its respective ends but these are not sufficiently large to permit movement of the bottles thereat. The package may be readily opened by piercing the sleeve material at any region such as between bottles or at its ends. One or two individual bottles may be removed from the package while the remainder are firmly retained. The completed package is extremely durable against damage both during shipment and handling by preventing relative bottle movement. The sleeve also provides light-inhibiting properties to protect the bottle contents.

POWER TRAIN MECHANISM

Figure 4:
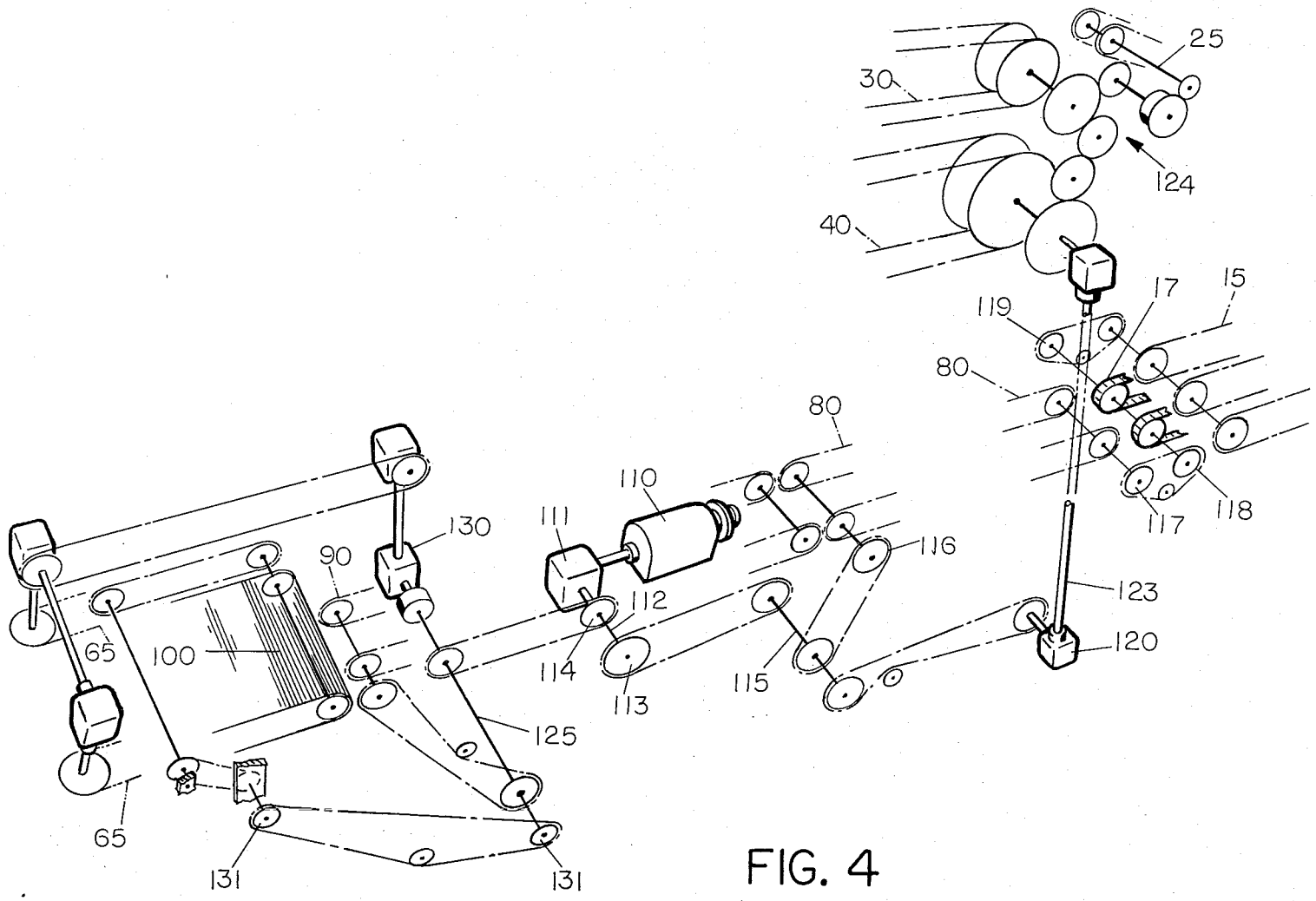
FIG. 4 is a schematic view of the central power source and movable conveyor and chain mechanisms and their interconnection within the machine shown in the foregoing views.

As schematically shown in FIG. 4, a central power source consisting of an electric motor 110 is mounted centrally beneath the machine with a main power shaft leading into a gear box 111. The outlet side of the gear box drives a pair of gears 113 and 114 on a common shaft which in turn drives all of the conveyors and finger chains of the machine. Gear 113 drives a shaft 115 which in turn drives bilevel conveyor 80 through a gear 116 on one end thereof. The opposite end of bilevel conveyor 80 has a shaft and gear 117 which through a suitable chain and gear assembly 118 drive all of the infeed conveyors 15 and 17 through another gear 119 mounted on a common shaft with gear 118.

Drive shaft 115 also powers a second gear box 120 through a pair of gears 121 and 122 through a connection chain. Gear box 120 drives a vertical shaft 123 which in turn drives the shoe conveyor 40 through a suitable shaft at one end thereof adjacent the inclined sleeve spacing conveyor 25. Upper sleeve retention conveyor 30 and inclined spacing conveyor 25 are both driven in synchronism by a suitable series of intermeshing gears designated by the numeral 124.

As stated, gear 114 on main drive shaft 112 drives another shaft 125 which in turn drives the output end of smooth-surfaced conveyor 90. Shaft 125 also serves to drive a third gear box 130 which in turn drives the pair of insertion finger chains 65 mounted in parallel on opposite sides of conveyors 52, 70 and 80. Shaft 125 also serves to drive roller conveyor 100 of the shrink tunnel oven through a pair of chain-connected gears 131, one of which is located on shaft 125.

Various modifications may be resorted to within the spirit and scope of the appended claims.

We claim:

1. The method of applying a preformed heat-shrinkable flexible tubular wrap to a plurality of similar articles arranged in a group comprising the steps of supplying said tubular wrap in double-folded flat condition, opening the tubular wrap in two stages during its conveyance above and parallel to the supply source for said articles, moving said opened tubular wrap in an axial direction at one lineal speed, gathering a predetermined group of said articles and moving same at a greater lineal speed to telescopically enter said opened tubular wrap traveling in coaxial alignment therewith, depositing and maintaining said group articles firmly together centrally within said wrap, and conveying said articles and surrounding wrap into a heating zone to heat-shrink the wrap into conforming relation around said articles.

2. The method in accordance with claim 1, including the step of continuing to hold said wrap in open condition during the deposition of said group of articles therewithin.

3. The method in accordance with claim 1, including the step of collecting said articles in two parallel rows and holding same together for their introduction during telescoping movement of said articles into said open wrap.

4. The method in accordance with claim 1, including the step of providing said tubular wrap having a predetermined length and diameter adapted to loosely surround the grouped articles prior to heat-shrinking.

5. The method in accordance with claim 1, including the step of positively locating and restraining said articles wihin said wrap in physically-contacting uniform central alignment prior to conveyance into said heating zone.

6. The method in accordance with claim 1, including the step providing a tubular wrap comprised of co-extruded film and foam polyethylene sheet having a thickness ranging from about 4 to b 10 mils.

7. The method in accordance with claim 1, wherein said articles consist of glass bottles aligned in two parallel rows in surface-to-surface contact, said wrap surrounding said bottles in tight conformity after heat-shrinking except for annular openings at opposing end portions.

8. The method of applying a preformed heat-shrinkable flexible tubular wrap to a plurality of containers comprising the steps of supplying said tubular wrap in double-folded flat condition, said wrap being folded inwardly and axially along its opposing sides into gusset folds and non-symmetrically transversely of its length, unfolding the tubular wrap to fully open the same in two stages while being continuously conveyed, moving the wrap parallel to and in axial alignment with the supply source for said containers following its full opening while transporting the wrap at a prescribed lineal speed, collecting a predetermined group of said containers and moving the group at a greater lineal speed than said open wrap to telescope the group within said moving coaxially-aligned open wrap, depositing the grouped containers centrally within said open wrap during their continuous movement, conveying said containers in physically-contacting arrangement within said wrap to a heating zone, and heating the wrap within said zone to heat-shrink the same around said containers in tightly conforming relation.

9. The method in accordance with claim 8, wherein said tubular wrap is flattened being folded axially into gussets along its sides with its bottom portion having a greater width than its top portion, and with a non-central fold of the top portion on itself, the bottom portion having its corners exposed adapted to firm retention for ready opening of the sleeve.

10. The method in accordance with claim 8, including the step of maintaining the wrap in fully opened condition with an internal hollow shoe member during deposition of the grouped containers therein.

11. The method in accordance with claim 8, including the step of supporting said containers on an expandable sleeve-opening device resting on suitable bi-level conveyor means until said grouped containers are arranged centrally within said open wrap and are positively aligned and restrained therewith during their further conveyance.

12. The method in accordance with claim 8, including the step of conveying said tubular wrap at a first lineal speed during its initial partial unforlding, conveying said tubular wrap at a second greater lineal speed during its subsequent complete unfolding and positively maintaining said wrap fully open, and conveying the collected group of containers at a third still greater lineal speed during their telescopic movement into and deposition within said fully open wrap during their similtaneous coaxially-aligned conveyance.

13. The method of applying a preformed heat-shrinkable flexible tubular wrap to a plurality of containers comprising the steps of supplying said tubular wrap in double-folded flat condition, said wrap being folded inwardly and axially into gusset folds along its opposing sides and non-symmetrically transversely of its length, unfolding the tubular wrap lengthwise with a fluid jet and means to partially open the wrap during its continuous movement, further unfolding the tubular wrap by retaining its corners of greatest width and inverting the wrap during its further conveyance parallel to and in vertical alignment with the supply source for said containers, introducing a hollow pivotal carrier element into said wrap during its further inverted conveyance to fully open the same, collecting a predetermined two-row grouping of said containers and moving the group at a greater lineal speed than said open wrap positioned in axial alignment therewith to telescope the group within said moving coaxially-aligned wrap, depositing the grouped containers centrally within said open wrap during their continuous coaxial movement, conveying said containers in physically-contacting arrangement within said wrap to a heating zone, and heating the wrap within said zone to shrink the same around said containers into tightly conforming relation.

14. Combined apparatus for applying a preformed heat-shrinkable flexible tubular wrap to a plurality of containers comprising means for supplying said tubular wrap in double-folded flat condition, said wrap being folded inwardly and axially along its opposing sides and non-symmetrially transversely of its length, vacuum means and a pair of rolls adapted to partially open said wraps serially, a pair of finger elements mounted on first conveyor means adapted to contact end portions of each said wrap for its conveyance serially through a lineal and arcuate path, a hollow shoe element mounted on a second conveyor means adapted to telescopically penetrate and further open the said wrap conveyed thereon, means for collecting and conveying a prescribed group of containers telescopically within said wrap during their simultaneous coaxial movement, means for depositing and restraining the collected group of containers centrally within said wrap during their continuous simultaneous movement, means for further conveying said containers in physically-contacting relation within said wrap through a heating zone, and means for heating the wrap within said zone to heat-shrink the same around said containers in tightly-conforming relation.

15. Combined apparatus in accordance with claim 14, wherein said means for supplying said tubular wrap comprises a magazine holder adapted to retain a plurality of said wraps in double-folded nested flattened condition.

16. Combined apparatus in accordance with claim 14, wherein said means for depositing the collected group of said containers includes retention means mounted along said conveyor means adapted to move simultaneously therewith and retain two rows of said containers in tangentially-contacting alignment within said wrap.

17. Combined apparatus in accordance with claim 14, including a series of spaced-apart pairs of finger elements mounted adjacent and adapted to simultaneous movement with said first conveyor means for transporting said wraps serially.

18. Combined apparatus in accordance with claim 14, including a series of spaced-apart hollow shoe elements mounted on said second conveyor means adapted to wrap penetration telescopically for further opening of said wraps serially.

19. Combined apparatus in accordance with claim 14, wherein said heating means for said wrap comprises a tunnel oven having a conveyor passing therethrough and heating elements therewithin.

20. Combined apparatus in accordance with claim 14, wherein said hollow shoe element is adapted to simultaneously retain the wrap in fully open condition and permit telescopic entry of two rows of containers therewithin.

21. Combined apparatus for applying a preformed heat-shrinkable flexible tubular wrap to a plurality of like containers retained in double-row alignment comprising holding means for retaining a plurality of preformed tubular wraps of predetermined length and diameter in double-folded flat condition, and air jet and vacuum means mounted adjacent said holding means adapted to partially open and deliver said wraps serially, first conveyor means having spaced-apart pairs of fingers thereon adapted to transport said partially open wraps serially through a lineal and arcuate path, second conveyor means having a series of spaced-apart hollow shoe elements mounted thereon each adapted to internally penetrate and fully open one of said wraps individually during their further conveyance in a lineal and arcuate path, means for collecting a double-row group of said containers in parallel vertical alignment with said second conveyor means and with the fully-opened wraps conveyed thereon, third conveyor means adapted to conveying the collected double-row group of said containers horizontally in coaxial alignment with an individual wrap and said hollow shoe element and transporting said group at a greater lineal speed than said wrap and shoe element to telescopically penetrate the same, means for depositing the collected group of containers centrally within said individual wrap during its continuous movement while held open by said shoe element and while said containers are conveyed by said third conveyor means, said third conveyor means being adapted to continuously conveying said containers while surrounded by said axially-aligned wrap, means for positively aligning and firmly restraining the said containers in physically-contacting relation within said wrap adjacent the discharge end of said third conveyor means for heating the wrap to heat-shrink the same around said containers in tightly-conforming relation.

22. Combined apparatus in accordance with claim 20, including juxtaposed pairs of pivotally-mounted arms on said positively-aligning means for moving and maintaining said double row group of containers in tight physically-contacting tangential relation during their conveyance within said wrap on said third conveyor means.

23. Combined apparatus in accordance with claim 21, wherein said first, second and third conveyor means are aligned parallel in vertical array with each being adapted to greater lineal speed than the former for their operation in precisely-timed synchronous relation.

24. Combined apparatus in accordance with claim 21, wherein said hollow shoe elements are each comprised of at least one firmly-mounted T-shaped member and one pivotally-expandable member adapted to controlled expansion within an individual wrap for its full opening into a rectangularly-shaped hollow tubular form.

25. Combined apparatus in accordance with claim 21, wherein said means for collecting a double-row group of said containers comprises a detector for ensuring that the requisite number of containers are present and pusher arm elements arranged in pairs adapted to engage the last pair of said aligned containers on said third conveyor means for initially transporting said group thereon in tight alignment.

* * * * *